US008820275B2

(12) United States Patent
McAlister et al.

(10) Patent No.: US 8,820,275 B2
(45) Date of Patent: Sep. 2, 2014

(54) TORQUE MULTIPLIER ENGINES

(75) Inventors: Roy Edward McAlister, Phoenix, AZ (US); Melvin James Larsen, Chandler, AZ (US); Roy Edward McAlister, legal representative, Chandler, AZ (US)

(73) Assignee: McAlister Technologies, LLC, Phoenix, AZ (US)

( * ) Notice: Subject to any disclaimer, the term of this patent is extended or adjusted under 35 U.S.C. 154(b) by 0 days.

(21) Appl. No.: 13/396,572

(22) Filed: Feb. 14, 2012

(65) Prior Publication Data

US 2012/0234297 A1 Sep. 20, 2012

Related U.S. Application Data

(60) Provisional application No. 61/442,768, filed on Feb. 14, 2011.

(51) Int. Cl.
*F02B 25/00* (2006.01)

(52) U.S. Cl.
USPC ..... 123/47 R; 123/53.1; 123/51 A

(58) Field of Classification Search
USPC ..... 123/47 R, 46 R, 51 R, 56.2, 56.1, 56.8
See application file for complete search history.

(56) References Cited

U.S. PATENT DOCUMENTS

| | | | | |
|---|---|---|---|---|
| 1,451,384 | A | 4/1923 | Whyte | |
| 1,765,237 | A | 6/1930 | King | |
| 2,068,038 | A * | 1/1937 | Prothero et al. | 123/51 B |
| 2,215,793 | A | 9/1940 | Mayes | |
| 2,255,203 | A | 9/1941 | Wiegand | |
| 2,441,277 | A | 5/1948 | Lamphere | |
| 2,721,100 | A | 10/1955 | Bodine, Jr. | |
| 3,058,453 | A | 10/1962 | May | |
| 3,060,912 | A | 10/1962 | May | |
| 3,081,758 | A | 3/1963 | May | |
| 3,243,335 | A | 3/1966 | Faile | |
| 3,286,164 | A | 11/1966 | De Huff | |
| 3,373,724 | A | 3/1968 | Papst | |

(Continued)

FOREIGN PATENT DOCUMENTS

| | | | |
|---|---|---|---|
| DE | 3443022 | A1 | 5/1986 |
| DE | 102005060139 | A1 | 6/2007 |

(Continued)

OTHER PUBLICATIONS

International Search Report and Written Opinion for PCT Application No. PCT/US2011/024797; Applicant: McAlister Technologies, LLC; Date of Mailing: Feb. 14, 2011; 8 pages.

(Continued)

*Primary Examiner* — Noah Kamen
*Assistant Examiner* — Long T Tran
(74) *Attorney, Agent, or Firm* — Perkins Coie LLP

(57) ABSTRACT

Torque multiplier engines, and associated methods and systems, are disclosed herein. An internal combustion engine in accordance with a particular embodiment can include a connecting rod operably coupling a pair of opposing pistons. The engine can further include a first bearing coupled to the connecting rod and positioned to engage a first cam groove of an inner cam drum. A second bearing coupled to the connecting rod can be positioned to engage a second cam groove on an outer cam drum. The first and second bearings can translate linear motion of the opposing pistons to rotation of the cam drums.

17 Claims, 12 Drawing Sheets

(56) References Cited

U.S. PATENT DOCUMENTS 3,391,680 A 7/1968 Benson
3,520,961 A 7/1970 Suda et al.
3,594,877 A 7/1971 Suda et al.
3,608,050 A 9/1971 Carman et al.
3,689,293 A 9/1972 Beall
3,745,887 A * 7/1973 Striegl ..... 92/146
3,789,807 A 2/1974 Pinkerton
3,926,169 A 12/1975 Leshner et al.
3,931,438 A 1/1976 Beall et al.
3,958,540 A 5/1976 Siewert
3,960,995 A 6/1976 Kourkene
3,976,039 A 8/1976 Henault
3,980,056 A 9/1976 Kraus
3,997,352 A 12/1976 Beall
4,020,803 A 5/1977 Thuren et al.
4,041,910 A 8/1977 Houseman
4,062,338 A 12/1977 Toth
4,066,046 A 1/1978 McAlister
4,095,580 A 6/1978 Murray et al.
4,105,004 A 8/1978 Asai et al.
4,116,389 A 9/1978 Furtah et al.
4,122,816 A 10/1978 Fitzgerald et al.
4,135,481 A 1/1979 Resler, Jr.
4,172,921 A 10/1979 Kiefer
4,183,467 A 1/1980 Sheraton et al.
4,203,393 A 5/1980 Giardini
4,281,797 A 8/1981 Kimata et al.
4,288,981 A 9/1981 Wright
4,293,188 A 10/1981 McMahon
4,303,045 A 12/1981 Austin, Jr.
4,330,732 A 5/1982 Lowther
4,332,223 A 6/1982 Dalton
4,364,342 A 12/1982 Asik
4,364,363 A 12/1982 Miyagi et al.
4,368,707 A 1/1983 Leshner et al.
4,377,455 A 3/1983 Kadija et al.
4,381,740 A 5/1983 Crocker
4,382,189 A 5/1983 Wilson
4,391,914 A 7/1983 Beall
4,413,474 A * 11/1983 Moscrip ..... 60/517
4,432,310 A * 2/1984 Waller ..... 123/56.8
4,448,160 A 5/1984 Vosper
4,469,160 A 9/1984 Giamei
4,483,485 A 11/1984 Kamiya et al.
4,511,612 A 4/1985 Huther et al.
4,528,270 A 7/1985 Matsunaga
4,536,452 A 8/1985 Stempin et al.
4,553,508 A * 11/1985 Stinebaugh ..... 123/56.7
4,567,857 A 2/1986 Houseman et al.
4,574,037 A 3/1986 Samejima et al.
4,677,960 A 7/1987 Ward
4,684,211 A 8/1987 Weber et al.
4,688,538 A 8/1987 Ward et al.
4,700,891 A 10/1987 Hans et al.
4,716,874 A 1/1988 Hilliard et al.
4,733,646 A 3/1988 Iwasaki
4,736,718 A 4/1988 Linder
4,742,265 A 5/1988 Giachino et al.
4,760,818 A 8/1988 Brooks et al.
4,760,820 A 8/1988 Tozzi
4,774,914 A 10/1988 Ward
4,774,919 A 10/1988 Matsuo et al.
4,777,925 A 10/1988 LaSota
4,834,033 A 5/1989 Larsen
4,841,925 A 6/1989 Ward
4,884,533 A 12/1989 Risitano et al.
4,922,883 A 5/1990 Iwasaki
4,932,263 A 6/1990 Wlodarczyk
4,967,708 A 11/1990 Linder et al.
4,977,873 A 12/1990 Cherry et al.
4,979,406 A * 12/1990 Waller ..... 74/567
4,982,708 A 1/1991 Stutzenberger
5,034,852 A 7/1991 Rosenberg
5,035,360 A 7/1991 Green et al.
5,036,669 A 8/1991 Earleson et al.
5,055,435 A 10/1991 Hamanaka et al.
5,056,496 A 10/1991 Morino et al.
5,069,189 A 12/1991 Saito
5,072,617 A 12/1991 Weiss
5,076,223 A 12/1991 Harden et al.
5,095,742 A 3/1992 James et al.
5,107,673 A 4/1992 Sato et al.
5,109,817 A 5/1992 Cherry
5,125,366 A 6/1992 Hobbs
5,131,376 A 7/1992 Ward et al.
5,150,682 A 9/1992 Magnet
5,178,119 A 1/1993 Gale
5,193,515 A 3/1993 Oota et al.
5,207,208 A 5/1993 Ward
5,211,142 A 5/1993 Matthews et al.
5,220,901 A 6/1993 Morita et al.
5,222,481 A 6/1993 Morikawa
5,267,601 A 12/1993 Dwivedi
5,297,518 A 3/1994 Cherry
5,305,360 A 4/1994 Remark et al.
5,328,094 A 7/1994 Goetzke et al.
5,329,606 A 7/1994 Andreassen
5,343,699 A 9/1994 McAlister
5,345,906 A 9/1994 Luczak
5,377,633 A 1/1995 Wakeman
5,390,546 A 2/1995 Wlodarczyk
5,392,745 A 2/1995 Beck
5,394,838 A 3/1995 Chandler
5,394,852 A 3/1995 McAlister
5,421,195 A 6/1995 Wlodarczyk
5,421,299 A 6/1995 Cherry
5,435,286 A 7/1995 Carroll, III et al.
5,439,532 A 8/1995 Fraas
5,456,241 A 10/1995 Ward
5,475,772 A 12/1995 Hung et al.
5,497,744 A 3/1996 Nagaosa et al.
5,517,961 A 5/1996 Ward
5,531,199 A 7/1996 Bryant et al.
5,549,746 A 8/1996 Scott et al.
5,568,801 A 10/1996 Paterson et al.
5,584,490 A 12/1996 Inoue et al.
5,588,299 A 12/1996 DeFreitas
5,605,125 A 2/1997 Yaoita
5,607,106 A 3/1997 Bentz et al.
5,608,832 A 3/1997 Pfandl et al.
5,647,309 A 7/1997 Avery
5,662,389 A 9/1997 Truglio et al.
5,676,026 A 10/1997 Tsuboi et al.
5,694,761 A 12/1997 Griffin, Jr.
5,699,253 A 12/1997 Puskorius et al.
5,702,761 A 12/1997 DiChiara, Jr. et al.
5,704,321 A 1/1998 Suckewer et al.
5,704,553 A 1/1998 Wieczorek et al.
5,714,680 A 2/1998 Taylor et al.
5,715,788 A 2/1998 Tarr et al.
5,733,105 A * 3/1998 Beckett et al. ..... 417/269
5,738,818 A 4/1998 Atmur et al.
5,745,615 A 4/1998 Atkins et al.
5,746,171 A 5/1998 Yaoita
5,767,026 A 6/1998 Kondoh et al.
5,797,427 A 8/1998 Buescher
5,806,581 A 9/1998 Haasch et al.
5,816,217 A 10/1998 Wong
5,853,175 A 12/1998 Udagawa
5,863,326 A 1/1999 Nause et al.
5,876,659 A 3/1999 Yasutomi et al.
5,915,272 A 6/1999 Foley et al.
5,930,420 A 7/1999 Atkins et al.
5,941,207 A 8/1999 Anderson et al.
5,947,091 A 9/1999 Krohn et al.
5,975,032 A 11/1999 Iwata
5,983,855 A 11/1999 Benedikt et al.
6,000,628 A 12/1999 Lorraine
6,015,065 A 1/2000 McAlister
6,017,390 A 1/2000 Charych et al.
6,021,573 A * 2/2000 Kikuchi et al. ..... 30/392
6,026,568 A 2/2000 Atmur et al.
6,029,627 A 2/2000 VanDyne
6,042,028 A 3/2000 Xu

(56) References Cited

U.S. PATENT DOCUMENTS 6,062,498 A 5/2000 Klopfer
6,081,183 A 6/2000 Mading et al.
6,085,990 A 7/2000 Augustin
6,092,501 A 7/2000 Matayoshi et al.
6,092,507 A 7/2000 Bauer et al.
6,093,338 A 7/2000 Tani et al.
6,102,303 A 8/2000 Bright et al.
6,131,607 A 10/2000 Cooke
6,138,639 A 10/2000 Hiraya et al.
6,155,212 A 12/2000 McAlister
6,157,011 A 12/2000 Lai
6,173,913 B1 1/2001 Shafer et al.
6,176,075 B1 1/2001 Griffin, Jr.
6,185,355 B1 2/2001 Hung
6,189,522 B1 2/2001 Moriya
6,253,728 B1 7/2001 Matayoshi et al.
6,267,307 B1 7/2001 Pontoppidan
6,281,976 B1 8/2001 Taylor et al.
6,318,306 B1 11/2001 Komatsu
6,335,065 B1 1/2002 Steinlage et al.
6,338,445 B1 1/2002 Lambert et al.
6,340,015 B1 1/2002 Benedikt et al.
6,360,721 B1 3/2002 Schuricht et al.
6,378,485 B2 4/2002 Elliott
6,386,178 B1 5/2002 Rauch
6,436,196 B1 8/2002 Buchanan et al.
6,446,597 B1 9/2002 McAlister
6,453,660 B1 9/2002 Johnson et al.
6,455,173 B1 9/2002 Marijnissen et al.
6,455,451 B1 9/2002 Brodkin et al.
6,478,007 B2 11/2002 Miyashita et al.
6,483,311 B1 11/2002 Ketterer et al.
6,487,858 B2 * 12/2002 Cammack ..... 60/517
6,490,391 B1 12/2002 Zhao et al.
6,501,875 B2 12/2002 Zhao et al.
6,503,584 B1 1/2003 McAlister
6,506,336 B1 1/2003 Beall et al.
6,516,114 B2 2/2003 Zhao et al.
6,517,011 B1 2/2003 Ayanji et al.
6,517,623 B1 2/2003 Brodkin et al.
6,532,315 B1 3/2003 Hung et al.
6,536,405 B1 3/2003 Rieger et al.
6,542,663 B1 4/2003 Zhao et al.
6,543,700 B2 4/2003 Jameson et al.
6,549,713 B1 4/2003 Pi et al.
6,550,458 B2 4/2003 Yamakado et al.
6,556,746 B1 4/2003 Zhao et al.
6,561,168 B2 5/2003 Hokao et al.
6,567,599 B2 5/2003 Hung
6,571,035 B1 5/2003 Pi et al.
6,578,775 B2 6/2003 Hokao
6,583,901 B1 6/2003 Hung
6,584,244 B2 6/2003 Hung
6,585,171 B1 7/2003 Boecking
6,587,239 B1 7/2003 Hung
6,599,028 B1 7/2003 Shu et al.
6,615,810 B2 9/2003 Funk et al.
6,615,899 B1 9/2003 Woodward et al.
6,619,269 B1 9/2003 Stier et al.
6,621,964 B2 9/2003 Quinn et al.
6,637,382 B1 10/2003 Brehob et al.
6,647,948 B2 11/2003 Kyuuma et al.
6,663,027 B2 12/2003 Jameson et al.
6,668,630 B1 12/2003 Kuglin et al.
6,672,277 B2 1/2004 Yasuoka et al.
6,700,306 B2 3/2004 Nakamura et al.
6,705,274 B2 3/2004 Kubo
6,719,224 B2 4/2004 Enomoto et al.
6,722,339 B2 4/2004 Elliott
6,722,340 B1 4/2004 Sukegawa et al.
6,722,840 B2 4/2004 Fujisawa et al.
6,725,826 B2 4/2004 Esteghlal
6,742,482 B2 6/2004 Artola
6,745,744 B2 6/2004 Suckewer et al.
6,748,918 B2 6/2004 Rieger et al.
6,749,043 B2 6/2004 Brown et al.
6,755,175 B1 6/2004 McKay et al.
6,756,140 B1 6/2004 McAlister
6,763,811 B1 7/2004 Tamol, Sr.
6,776,352 B2 8/2004 Jameson
6,779,513 B2 8/2004 Pellizzari et al.
6,796,284 B1 9/2004 Wielligh
6,796,516 B2 9/2004 Maier et al.
6,799,513 B2 10/2004 Schafer
6,802,894 B2 10/2004 Brodkin et al.
6,811,103 B2 11/2004 Gurich et al.
6,814,064 B2 11/2004 Cowans
6,814,313 B2 11/2004 Petrone et al.
6,832,472 B2 12/2004 Huang et al.
6,832,588 B2 12/2004 Herden et al.
6,845,920 B2 1/2005 Sato et al.
6,851,413 B1 2/2005 Tamol, Sr.
6,854,438 B2 2/2005 Hilger et al.
6,871,630 B2 3/2005 Herden et al.
6,883,490 B2 4/2005 Jayne
6,892,971 B2 5/2005 Rieger et al.
6,898,355 B2 5/2005 Johnson et al.
6,899,076 B2 5/2005 Funaki et al.
6,904,893 B2 6/2005 Hotta et al.
6,912,998 B1 7/2005 Rauznitz et al.
6,925,983 B2 8/2005 Herden et al.
6,935,284 B2 8/2005 Qian et al.
6,940,213 B1 9/2005 Heinz et al.
6,954,074 B2 10/2005 Zhu et al.
6,955,154 B1 10/2005 Douglas
6,955,165 B2 10/2005 Liu
6,959,693 B2 11/2005 Oda
6,976,683 B2 12/2005 Eckert et al.
6,984,305 B2 1/2006 McAlister
6,993,960 B2 2/2006 Benson
6,994,073 B2 2/2006 Tozzi et al.
7,007,658 B1 3/2006 Cherry et al.
7,007,661 B2 3/2006 Warlick
7,013,863 B2 3/2006 Shiraishi et al.
7,025,358 B2 4/2006 Ueta et al.
7,032,845 B2 4/2006 Dantes et al.
7,070,126 B2 7/2006 Shinogle
7,073,480 B2 7/2006 Shiraishi et al.
7,077,100 B2 7/2006 Vogel et al.
7,077,108 B2 7/2006 Fujita et al.
7,077,379 B1 7/2006 Taylor
7,086,376 B2 8/2006 McKay
7,104,246 B1 9/2006 Gagliano et al.
7,104,250 B1 9/2006 Yi et al.
7,121,253 B2 10/2006 Shiraishi et al.
7,124,718 B2 10/2006 Artola
7,131,426 B2 11/2006 Ichinose et al.
7,137,382 B2 11/2006 Zhu et al.
7,138,046 B2 11/2006 Roychowdhury
7,140,347 B2 11/2006 Suzuki et al.
7,140,353 B1 11/2006 Rauznitz et al.
7,140,562 B2 11/2006 Holzgrefe et al.
7,198,208 B2 4/2007 Dye et al.
7,201,136 B2 4/2007 McKay et al.
7,204,133 B2 4/2007 Benson et al.
7,214,883 B2 5/2007 Leyendecker
7,228,840 B2 6/2007 Sukegawa et al.
7,249,578 B2 7/2007 Fricke et al.
7,255,290 B2 8/2007 Bright et al.
7,272,487 B2 9/2007 Christen et al.
7,278,392 B2 10/2007 Zillmer et al.
7,305,971 B2 12/2007 Fujii
7,309,029 B2 12/2007 Boecking
7,334,558 B2 * 2/2008 Higgins ..... 123/197.4
7,340,118 B2 3/2008 Wlodarczyk et al.
7,357,108 B2 * 4/2008 Gracyalny ..... 123/90.4
7,367,319 B2 5/2008 Kuo et al.
7,386,982 B2 6/2008 Runkle et al.
7,404,395 B2 7/2008 Yoshimoto
7,409,929 B2 8/2008 Miyahara et al.
7,418,940 B1 9/2008 Yi et al.
7,481,043 B2 1/2009 Hirata et al.
7,484,369 B2 2/2009 Myhre
7,513,222 B2 4/2009 Orlosky

(56) References Cited

U.S. PATENT DOCUMENTS

| | | | | |
|---|---|---|---|---|
| 7,527,041 | B2 | 5/2009 | Wing et al. | |
| 7,540,271 | B2 | 6/2009 | Stewart et al. | |
| 7,554,250 | B2 | 6/2009 | Kadotani et al. | |
| 7,574,983 | B2 | 8/2009 | Kuo | |
| 7,588,012 | B2 | 9/2009 | Gibson et al. | |
| 7,625,531 | B1 | 12/2009 | Coates et al. | |
| 7,626,315 | B2 | 12/2009 | Nagase | |
| 7,628,137 | B1 | 12/2009 | McAlister | |
| 7,650,873 | B2 | 1/2010 | Hofbauer et al. | |
| 7,703,775 | B2 | 4/2010 | Matsushita et al. | |
| 7,707,832 | B2 | 5/2010 | Commaret et al. | |
| 7,714,483 | B2 | 5/2010 | Hess et al. | |
| 7,728,489 | B2 | 6/2010 | Heinz et al. | |
| 7,753,659 | B2 * | 7/2010 | Boyl-Davis et al. | 417/237 |
| 7,849,833 | B2 | 12/2010 | Toyoda | |
| 7,880,193 | B2 | 2/2011 | Lam | |
| 7,886,993 | B2 | 2/2011 | Bachmaier et al. | |
| 7,898,258 | B2 | 3/2011 | Neuberth et al. | |
| 7,918,212 | B2 | 4/2011 | Verdejo et al. | |
| 7,938,102 | B2 | 5/2011 | Sherry | |
| 7,942,136 | B2 | 5/2011 | Lepsch et al. | |
| 8,069,836 | B2 | 12/2011 | Ehresman | |
| 8,091,528 | B2 | 1/2012 | McAlister | |
| 8,166,926 | B2 | 5/2012 | Sasaki et al. | |
| 8,297,254 | B2 | 10/2012 | McAlister | |
| 8,479,690 | B2 | 7/2013 | Maro | |
| 8,505,516 | B2 | 8/2013 | Cheiky | |
| 8,555,860 | B2 | 10/2013 | McAlister | |
| 2002/0017573 | A1 | 2/2002 | Sturman | |
| 2002/0070267 | A1 | 6/2002 | Okamura et al. | |
| 2002/0084793 | A1 | 7/2002 | Hung et al. | |
| 2002/0131171 | A1 | 9/2002 | Hung | |
| 2002/0131666 | A1 | 9/2002 | Hung et al. | |
| 2002/0131673 | A1 | 9/2002 | Hung | |
| 2002/0131674 | A1 | 9/2002 | Hung | |
| 2002/0131686 | A1 | 9/2002 | Hung | |
| 2002/0131706 | A1 | 9/2002 | Hung | |
| 2002/0131756 | A1 | 9/2002 | Hung | |
| 2002/0141692 | A1 | 10/2002 | Hung | |
| 2002/0150375 | A1 | 10/2002 | Hung et al. | |
| 2002/0151113 | A1 | 10/2002 | Hung et al. | |
| 2002/0166536 | A1 | 11/2002 | Hitomi et al. | |
| 2003/0012985 | A1 | 1/2003 | McAlister | |
| 2003/0042325 | A1 | 3/2003 | D'Arrigo | |
| 2003/0127531 | A1 | 7/2003 | Hohl | |
| 2004/0008989 | A1 | 1/2004 | Hung | |
| 2004/0182359 | A1 | 9/2004 | Stewart et al. | |
| 2004/0256495 | A1 | 12/2004 | Baker et al. | |
| 2005/0045146 | A1 | 3/2005 | McKay et al. | |
| 2005/0045148 | A1 | 3/2005 | Katsuragawa et al. | |
| 2005/0081805 | A1 * | 4/2005 | Novotny | 123/51 R |
| 2005/0098663 | A1 | 5/2005 | Ishii | |
| 2005/0255011 | A1 | 11/2005 | Greathouse et al. | |
| 2005/0257776 | A1 | 11/2005 | Bonutti | |
| 2006/0005738 | A1 | 1/2006 | Kumar | |
| 2006/0005739 | A1 | 1/2006 | Kumar | |
| 2006/0016916 | A1 | 1/2006 | Petrone et al. | |
| 2006/0037563 | A1 | 2/2006 | Raab et al. | |
| 2006/0102140 | A1 | 5/2006 | Sukegawa et al. | |
| 2006/0108452 | A1 | 5/2006 | Anzinger et al. | |
| 2006/0169244 | A1 | 8/2006 | Allen | |
| 2007/0034175 | A1 * | 2/2007 | Higgins | 123/53.3 |
| 2007/0142204 | A1 | 6/2007 | Park et al. | |
| 2007/0189114 | A1 | 8/2007 | Reiner et al. | |
| 2007/0283927 | A1 | 12/2007 | Fukumoto et al. | |
| 2008/0072871 | A1 | 3/2008 | Vogel et al. | |
| 2008/0081120 | A1 | 4/2008 | Ooij et al. | |
| 2008/0098984 | A1 | 5/2008 | Sakamaki | |
| 2008/0103672 | A1 | 5/2008 | Ueda et al. | |
| 2008/0289606 | A1 * | 11/2008 | Bahnev | 123/45 A |
| 2009/0078798 | A1 | 3/2009 | Gruendl et al. | |
| 2009/0093951 | A1 | 4/2009 | McKay et al. | |
| 2009/0145398 | A1 | 6/2009 | Kemeny | |
| 2009/0204306 | A1 | 8/2009 | Goeke et al. | |
| 2009/0223480 | A1 * | 9/2009 | Sleiman et al. | 123/243 |
| 2009/0264574 | A1 | 10/2009 | Ooij et al. | |
| 2010/0020518 | A1 | 1/2010 | Bustamante | |
| 2010/0043758 | A1 | 2/2010 | Caley | |
| 2010/0077986 | A1 | 4/2010 | Chen | |
| 2010/0077987 | A1 | 4/2010 | Voisin | |
| 2010/0108023 | A1 | 5/2010 | McAlister | |
| 2010/0174470 | A1 | 7/2010 | Bromberg et al. | |
| 2010/0183993 | A1 | 7/2010 | McAlister | |
| 2010/0206249 | A1 | 8/2010 | Bromberg et al. | |
| 2011/0036309 | A1 | 2/2011 | McAlister | |
| 2011/0042476 | A1 | 2/2011 | McAlister | |
| 2011/0048371 | A1 | 3/2011 | McAlister | |
| 2011/0048374 | A1 | 3/2011 | McAlister | |
| 2011/0048381 | A1 | 3/2011 | McAlister | |
| 2011/0056458 | A1 | 3/2011 | McAlister | |
| 2011/0057058 | A1 | 3/2011 | McAlister | |
| 2011/0132319 | A1 | 6/2011 | McAlister | |
| 2011/0134049 | A1 | 6/2011 | Lin et al. | |
| 2011/0146619 | A1 | 6/2011 | McAlister | |
| 2011/0210182 | A1 | 9/2011 | McAlister | |
| 2011/0233308 | A1 | 9/2011 | McAlister | |
| 2011/0253104 | A1 | 10/2011 | McAlister | |
| 2011/0259285 | A1 | 10/2011 | Michikawauchi et al. | |
| 2011/0259290 | A1 | 10/2011 | Michikawauchi et al. | |
| 2011/0265463 | A1 | 11/2011 | Kojima et al. | |

FOREIGN PATENT DOCUMENTS

| | | | |
|---|---|---|---|
| EP | 392594 | A2 | 10/1990 |
| EP | 671555 | A1 | 9/1995 |
| EP | 1972606 | A1 | 9/2008 |
| GB | 1038490 | A | 8/1966 |
| JP | 56-083516 | | 7/1981 |
| JP | 61-023862 | A | 2/1986 |
| JP | 02-259268 | A | 10/1990 |
| JP | 08-049623 | A | 2/1996 |
| JP | 2008-334077 | | 12/1996 |
| JP | 02-264124 | | 9/2002 |
| JP | 03-115742 | | 4/2003 |
| JP | 03-115743 | | 4/2003 |
| JP | 2004-324613 | A | 11/2004 |
| KR | 2007-0026296 | A | 3/2007 |
| KR | 2008-0073635 | A | 8/2008 |
| RU | 2101526 | | 1/1998 |
| WO | WO-2008-017576 | A1 | 2/2008 |

OTHER PUBLICATIONS

Non-Final Office Action for U.S. Appl. No. 13/027,170; Applicant: McAlister et al.; Date of Mailing: Jan. 12, 2012; 10 pages.

"Ford DIS/EDIS "Waste Spark" Ignition System." Accessed: Jul. 15, 2010. Printed: Jun. 8, 2011. <http://rockledge.home.comcast.net/~rockledge/RangerPictureGallery/DIS_EDIS.htm>. pp. 1-4.

"P dV's Custom Data Acquisition Systems Capabilities." PdV Consulting. Accessed: Jun. 28, 2010. Printed: May 16, 2011. <http://www.pdvconsult.com/capabilities%20-%20daqsys.html>. pp. 1-10.

"Piston motion equations." Wikipedia, the Free Encyclopedia. Published: Jul. 4, 2010. Accessed: Aug. 7, 2010. Printed: Aug. 7, 2010. <http://en.wikipedia.org/wiki/Dopant>. pp. 1-6.

"Piston Velocity and Acceleration." EPI, Inc. Accessed: Jun. 28, 2010. Printed: May 16, 2011. <http://www.epi-eng.com/piston_engine_technology/piston_velocity_and_acceleration.htm>. pp. 1-3.

"SmartPlugs—Aviation." SmartPlugs.com. Published: Sep. 2000. Accessed: May 31, 2011. <http://www.smartplugs.com/news/aeronews0900.htm>. pp. 1-3.

Bell et al. "A Super Solar Flare." NASA Science. Published: May 6, 2008. Accessed: May 17, 2011. <http://science.nasa.gov/science-news/science-at-nasa/2008/06may_carringtonflare/>. pp. 1-5.

Birchenough, Arthur G. "A Sustained-arc Ignition System for Internal Combustion Engines." Nasa Technical Memorandum (NASA TM-73833). Lewis Research Center. Nov. 1977. pp. 1-15.

Britt, Robert Roy. "Powerful Solar Storm Could Shut Down U.S. For Months—Science News | Science & Technology | Technology News—FOXNews.com." FoxNews.com, Published: Jan. 9, 2009. Accessed: May 17, 2011. <http://www.foxnews.com/story/0,2933,478024,00.html>. pp. 1-2.

(56) References Cited

OTHER PUBLICATIONS

Brooks, Michael. "Space Storm Alert: 90 Seconds from Catastrophe." NewScientist. Mar. 23, 2009. pp. 1-7.
Doggett, William. "Measuring Internal Combustion Engine In-Cylinder Pressure with LabVIEW." National Instruments. Accessed: Jun. 28, 2010. Printed: May 16, 2011. <http://sine.ni.com/cs/app/doc/p/id/cs-217>. pp. 1-2.
Hodgin, Rick. "NASA Studies Solar Flare Dangers to Earth-based Technology." TG Daily. Published: Jan. 6, 2009. Accessed: May 17, 2011. <http://www.tgdaily.com/trendwatch/40830- nasa-studies-solar-flare-dangers-to-earth-based-technology>. pp. 1-2.
InfraTec GmbH. "Evaluation Kit for FPI Detectors | Datasheet—Detector Accessory." 2009. pp. 1-2.
International Search Report and Written Opinion for Application No. PCT/US2009/067044; Applicant: McAlister Technologies, LLC.; Date of Mailing: Apr. 14, 2010 (11 pages).
International Search Report and Written Opinion for Application No. PCT/US2010/002076; Applicant: McAlister Technologies, LLC.; Date of Mailing: Apr. 29, 2011 (8 pages).
International Search Report and Written Opinion for Application No. PCT/US2010/002077; Applicant: McAlister Technologies, LLC.; Date of Mailing: Apr. 29, 2011 (8 pages).
International Search Report and Written Opinion for Application No. PCT/US2010/002078; Applicant: McAlister Technologies, LLC.; Date of Mailing: Dec. 17, 2010 (9 pages).
International Search Report and Written Opinion for Application No. PCT/US2010/042812; Applicant: McAlister Technologies, LLC.; Date of Mailing: May 13, 2011 (9 pages).
International Search Report and Written Opinion for Application No. PCT/US2010/042815; Applicant: McAlister Technologies, LLC.; Date of Mailing: Apr. 29, 2011 (10 pages).
International Search Report and Written Opinion for Application No. PCT/US2010/042817; Applicant: McAlister Technologies, LLC.; Date of Mailing: Apr. 29, 2011 (8 pages).
Lewis Research Center. "Fabry-Perot Fiber-Optic Temperature Sensor." NASA Tech Briefs. Published: Jan. 1, 2009. Accessed: May 16, 2011. <http://www.techbriefs.com/content/view/2114/32/>.
Pall Corporation, Pall Industrial Hydraulics. "Increase Power Output and Reduce Fugitive Emissions by Upgrading Hydrogen Seal Oil System Filtration." 2000. pp. 1-4.
Riza et al. "All-Silicon Carbide Hybrid Wireless-Wired Optics Temperature Sensor Network Basic Design Engineering for Power Plant Gas Turbines." International Journal of Optomechatronics, vol. 4, Issue 1. Jan 2010. pp. 83-91.
Riza et al. "Hybrid Wireless-Wired Optical Sensor for Extreme Temperature Measurement in Next Generation Energy Efficient Gas Turbines." Journal of Engineering for Gas Turbines and Power, vol. 132, Issue 5. May 2010. pp. 051601-1-51601-11.
Salib et al. "Role of Parallel Reformable Bonds in the Self-Healing of Cross-Linked Nanogel Particles." Langmuir, vol. 27, Issue 7. 2011. pp. 3991-4003.
Erjavec, Jack. "Automotive Technology: a Systems Approach, vol. 2." Thomson Delmar Learning. Clifton Park, NY. 2005. p. 845.
Hollembeak, Barry. "Automotive Fuels & Emissions." Thomson Delmar Learning. Clifton Park, NY. 2005. p. 298.
International Search Report and Written Opinion for Application No. PCT/US2010/002080; Applicant: McAlister Technologies, LLC.; Date of Mailing: Jul. 7, 2011 (8 pages).
International Search Report and Written Opinion for Application No. PCT/US2010/054361; Applicant: McAlister Technologies, LLC.; Date of Mailing: Oct. 27, 2010, 9 pages.
International Search Report and Written Opinion for Application No. PCT/US2010/054364; Applicant: McAlister Technologies, LLC.; Date of Mailing: Oct. 27, 2010, 8 pages.
International Search Report and Written Opinion for Application No. PCT/US2010/059146; Applicant: McAlister Technologies, LLC.; Date of Mailing: Dec. 6, 2010, 11 pages.
International Search Report and Written Opinion for Application No. PCT/US2010/059147; Applicant: McAlister Technologies, LLC.; Date of Mailing: Dec. 6, 2010, 11 pages.

* cited by examiner

TORQUE MULTIPLIER ENGINES

CROSS-REFERENCE TO RELATED APPLICATION(S)

The present application claims priority to and the benefit of U.S. Provisional Patent Application No. 61/442,768, filed Feb. 14, 2011, and entitled "TORQUE MULTIPLIER ENGINES," the entirety of which is incorporated by reference herein.

TECHNICAL FIELD

The present disclosure relates generally to internal combustion engines. More specifically, torque multiplier engines, including counter-rotational engines and rotary driven cam engines; multi-cycle engines; piston valves; and other engine related technologies are disclosed herein.

BACKGROUND

Various types of heat engines have supplied shaft work that energized the Industrial Revolution. Currently, internal combustion engines, specifically piston engines, provide the shaft work that enables a large portion of modern mobility and productivity. It is estimated that there is one piston engine powered vehicle for every ten persons on Earth and that more than 800 million piston engines are operated throughout the world.

Although conventional piston engines provide valuable mechanical energy, well known problems are presented by the efficiency limitations imposed by current engine designs. For example, conventional engines more heat than the amount of energy provided as output work. The energy wasted on unused heat reduces the overall efficiency of conventional engines and increases their operating costs.

In addition to efficiency losses from wasted heat, friction losses significantly reduce the overall efficiency of engines and/or the vehicles or machines that they power. For example, most automobiles include transmissions, differentials, and other components that are coupled to a vehicle's engine. These additional mechanical components are necessary because the relatively high rate of rotation of the crankshaft in most internal combustion engines requires a transmission to reduce the rotational speed to match a desired rotational tire speed. Additionally, differentials are often required to adjust the rotational speed of individual tires during cornering or in other situations that require wheel rotation at different rates. Each additional mechanical component between the engine and the tires introduces further opportunities for efficiency losses. Friction and heat losses in the transmission, the differential, or other components can thereby further reduce the efficiency of the vehicle. Accordingly, it is desirable to reduce these efficiency losses and provide an engine that can operate with greater overall efficiency.

BRIEF DESCRIPTION OF THE DRAWINGS

Certain details are set forth in the following description and in FIGS. 1-11 to provide a thorough understanding of various embodiments of the disclosure. Other details describing well-known structures and systems often associated with heat engines, internal combustion engines, etc., have not been set forth in the following disclosure to avoid unnecessarily obscuring the description of the various embodiments of the disclosure.

Many of the details, dimensions, angles and other features shown in the Figures are merely illustrative of particular embodiments of the disclosure. Accordingly, other embodiments can have other details, dimensions, angles and features without departing from the spirit or scope of the present invention. In addition, those of ordinary skill in the art will appreciate that further embodiments of the invention can be practiced without several of the details described below.

In the Figures, identical reference numbers identify identical, or at least generally similar, elements. To facilitate the discussion of any particular element, the most significant digit or digits of any reference number refers to the Figure in which that element is first introduced. For example, element 110 is first introduced and discussed with reference to FIG. 1.

Figure 1:
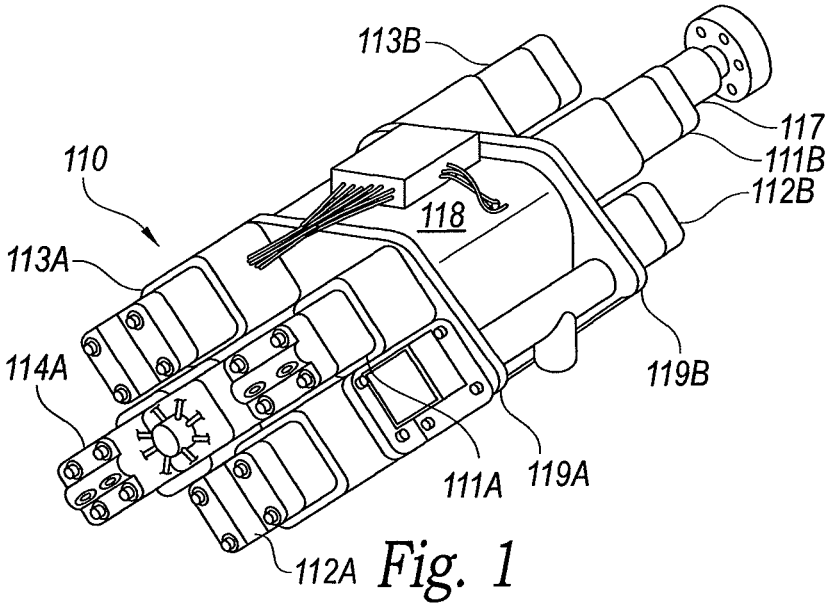

FIG. 1 is a perspective view of an internal combustion engine configured in accordance with the present disclosure.

Figure 2:
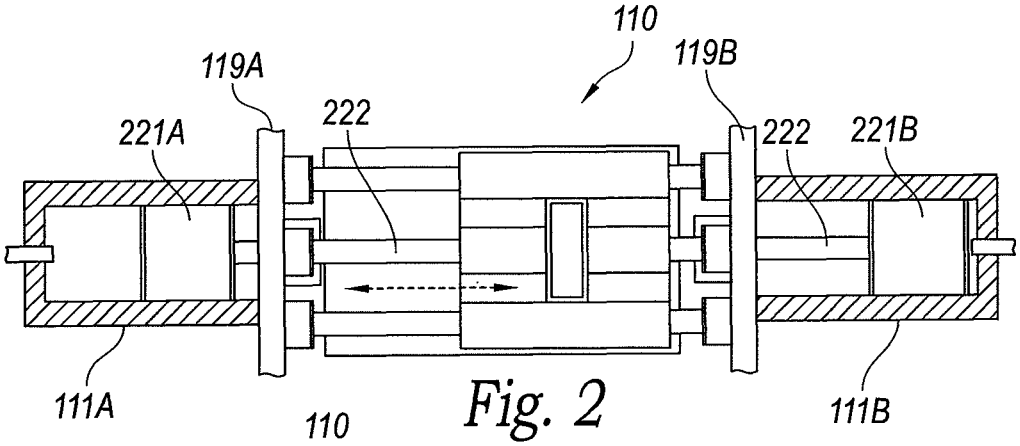

FIG. 2 is a partial cutaway top view of a cylinder pair of the internal combustion engine configured in accordance with the present disclosure.

Figure 3:
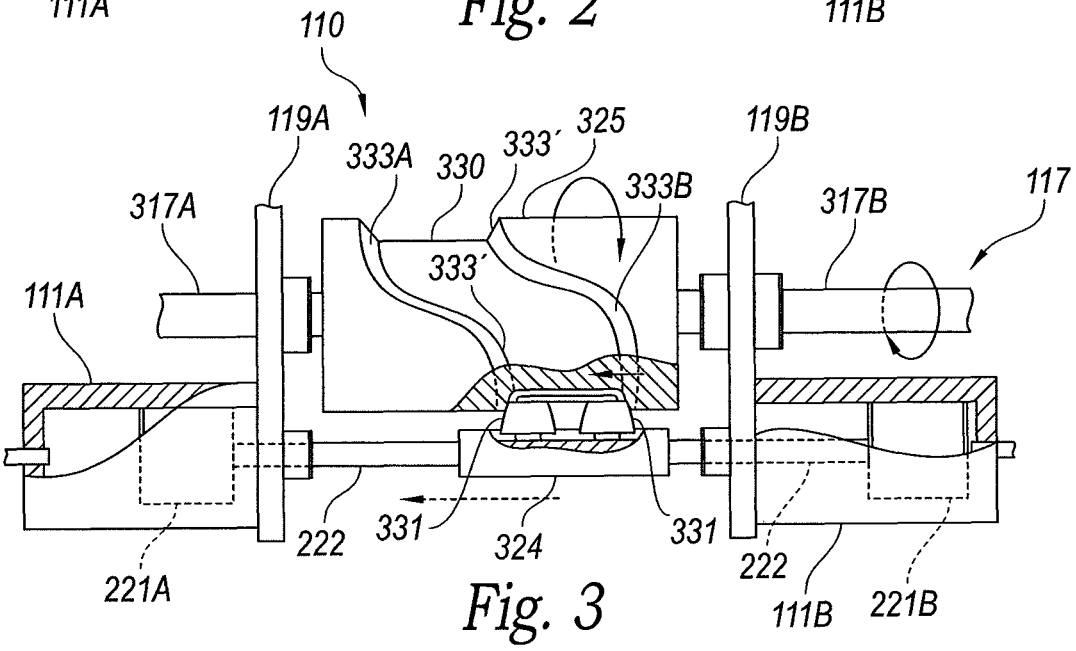

FIG. 3 is a partial cutaway top view of the cylinder pair and a cam drum configured in accordance with the present disclosure.

Figure 4:
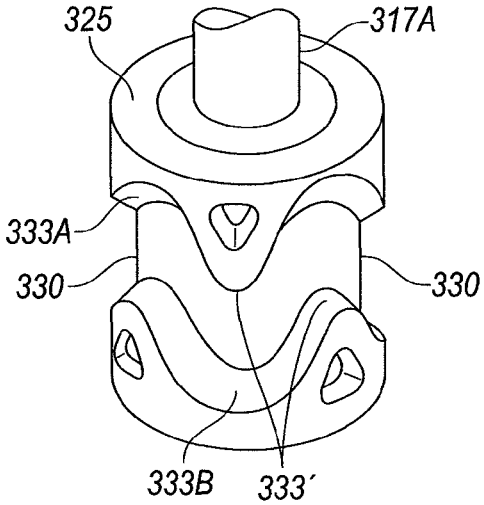

FIG. 4 is a perspective view of the cam drum of the internal combustion engine configured in accordance with the present disclosure.

Figure 5:
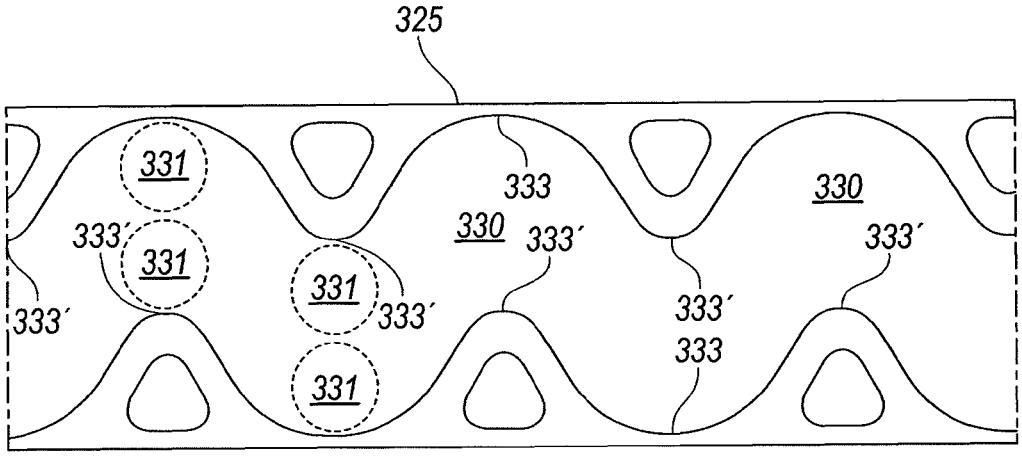

FIG. 5 illustrates an illustrative pattern of a groove of the cam drum configured in accordance with the present disclosure.

Figure 6B:
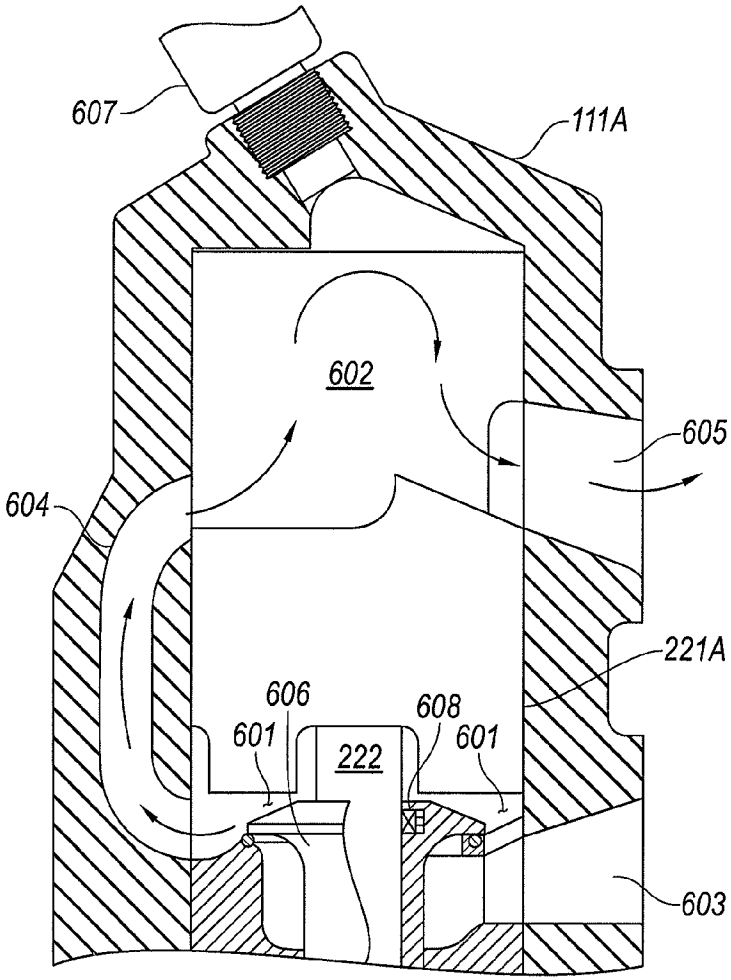
Figure 6A:
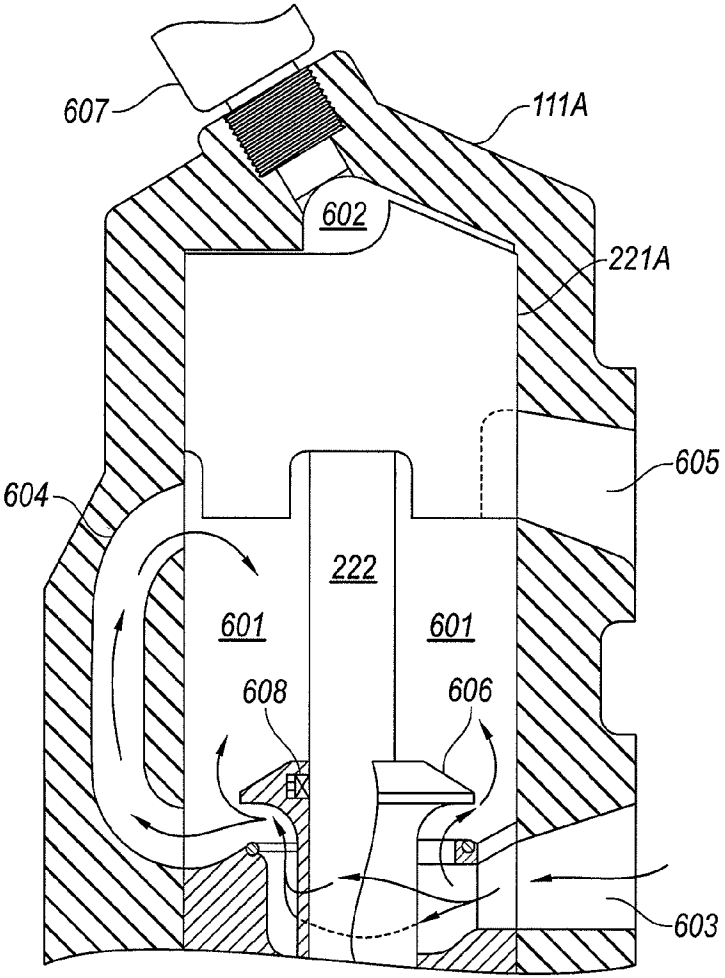

FIGS. 6A and 6B are cross-sectional views of a cylinder shown in FIG. 2 of the internal combustion engine configured in accordance with the present disclosure.

Figure 7A:
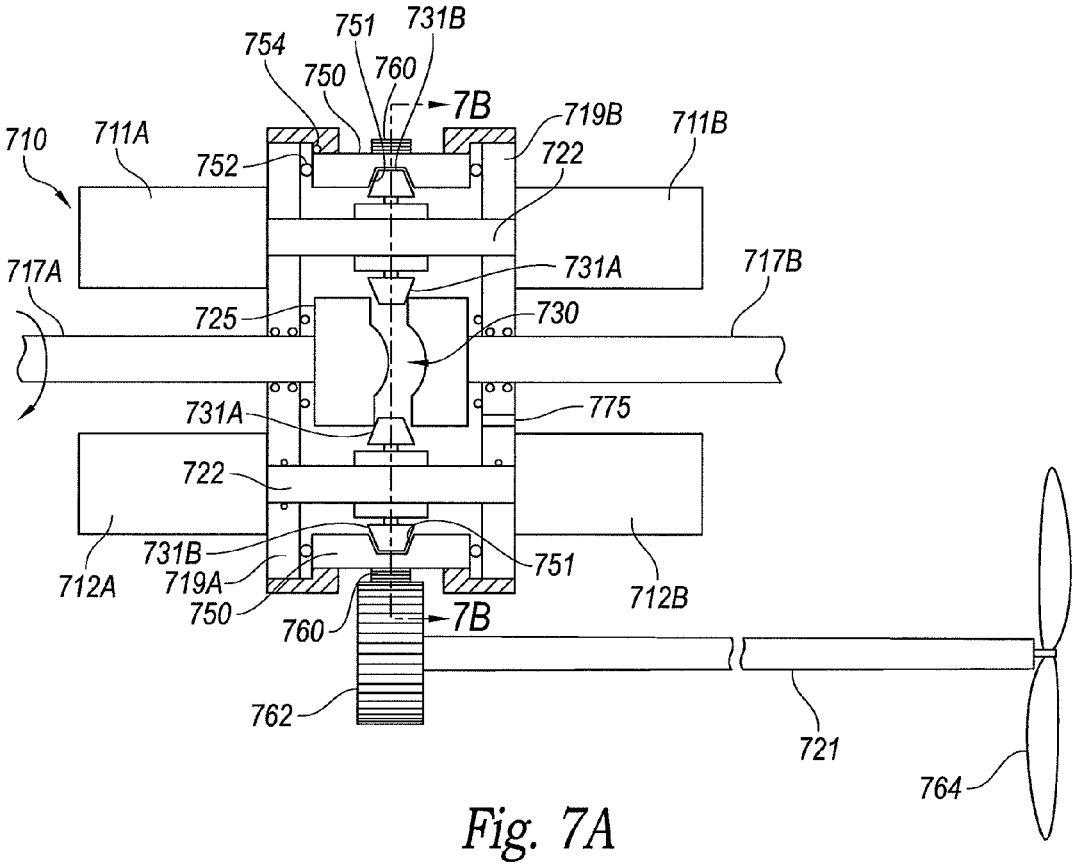

FIG. 7A is a partially schematic cross-sectional side view of an internal combustion engine configured in accordance with another embodiment of the disclosure.

Figure 7B:
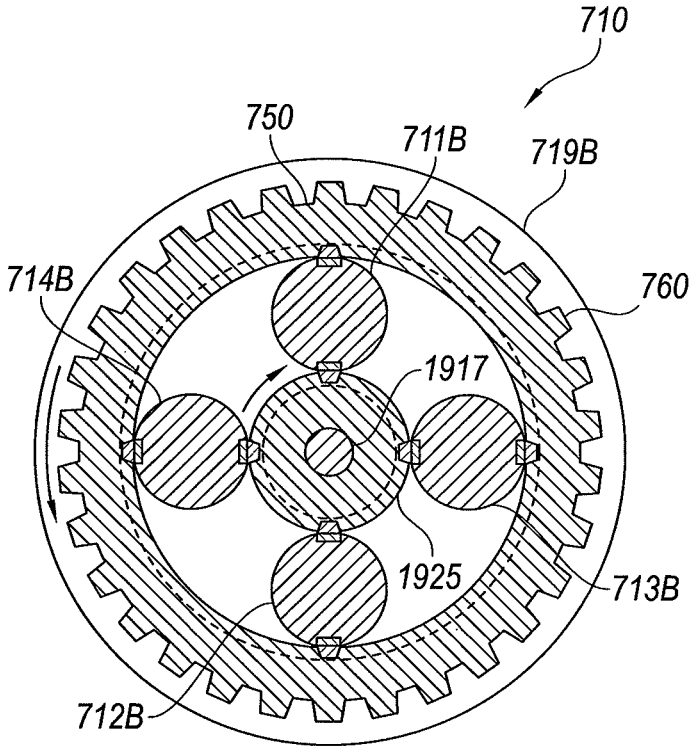

FIG. 7B is a partially schematic cross-sectional end view of the internal combustion engine of FIG. 7A.

Figure 8A:
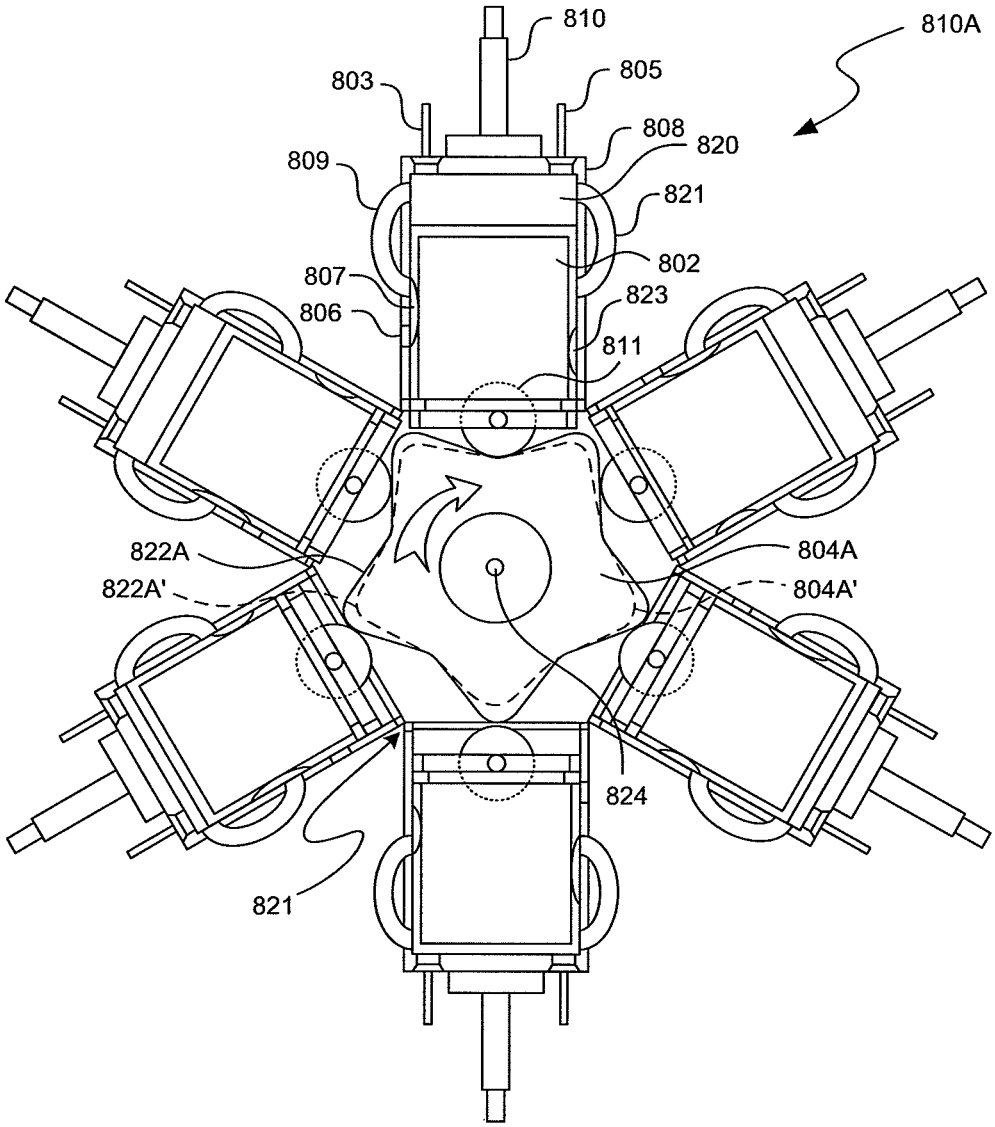

FIG. 8A is a partially schematic front view of an internal combustion engine configured in accordance with a further embodiment of the disclosure.

Figure 8B:
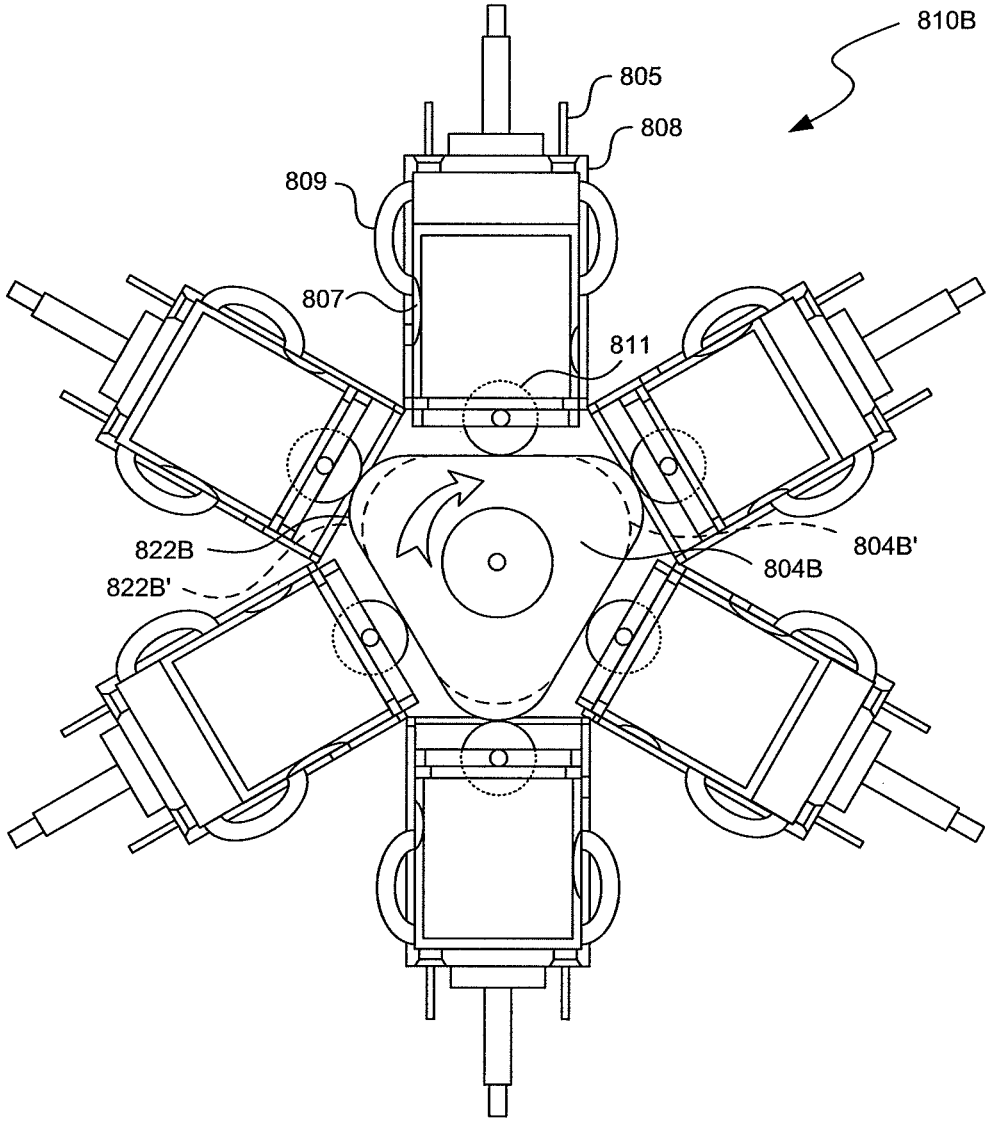

FIG. 8B is a partially schematic front view of an internal combustion engine configured in accordance with yet another embodiment of the disclosure.

Figure 8C:
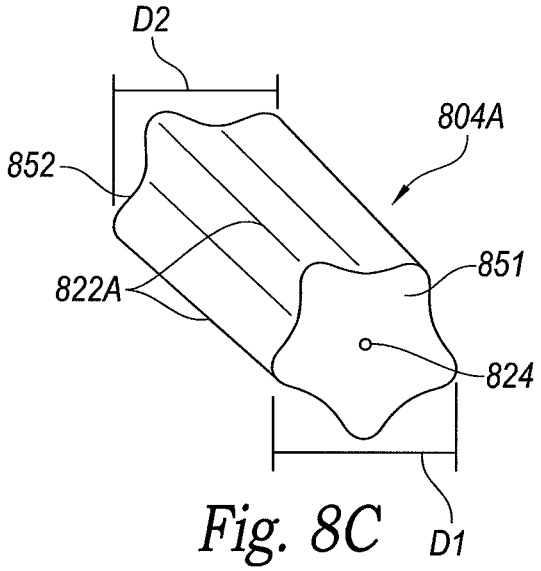
Figure 8D:
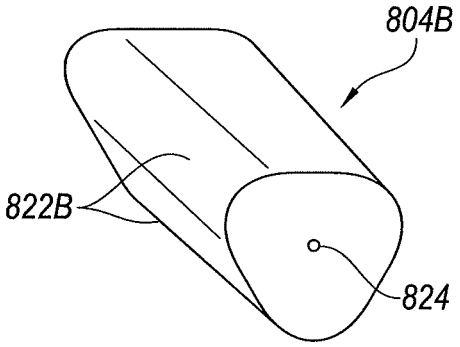
Figure 8E:
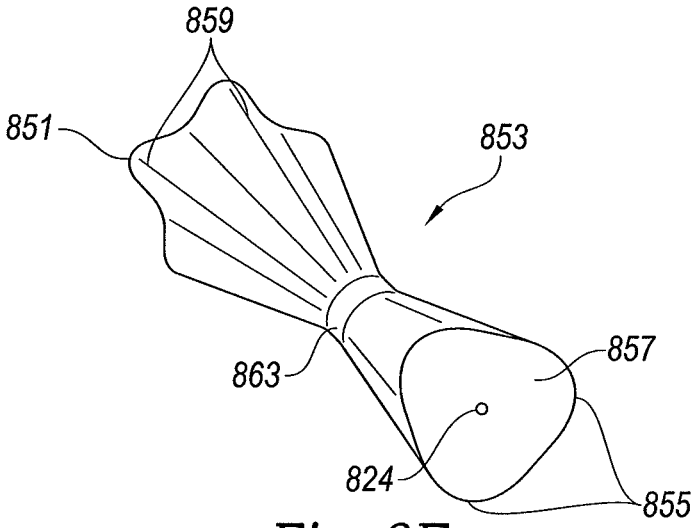

FIGS. 8C-8E are perspective views of cams configured in accordance with further embodiments of the disclosure.

FIGS. 9A-9D are partially schematic cutaway side views of cylinders having a piston valve system configured in accordance with an embodiment of the disclosure.

Figure 10:
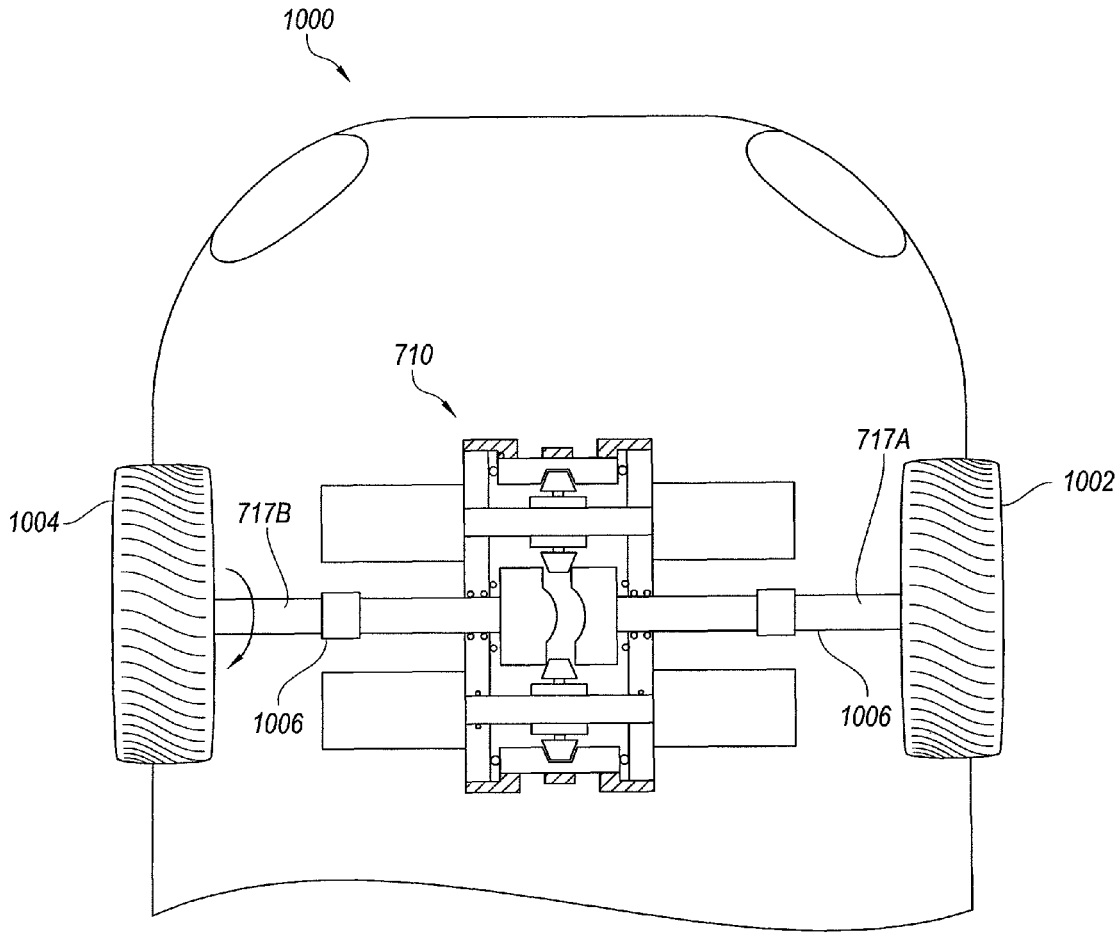

FIG. 10 is a partially cutaway overhead view of a portion an automobile having a counter-rotating engine configured in accordance with an embodiment of the present disclosure.

Figure 11:
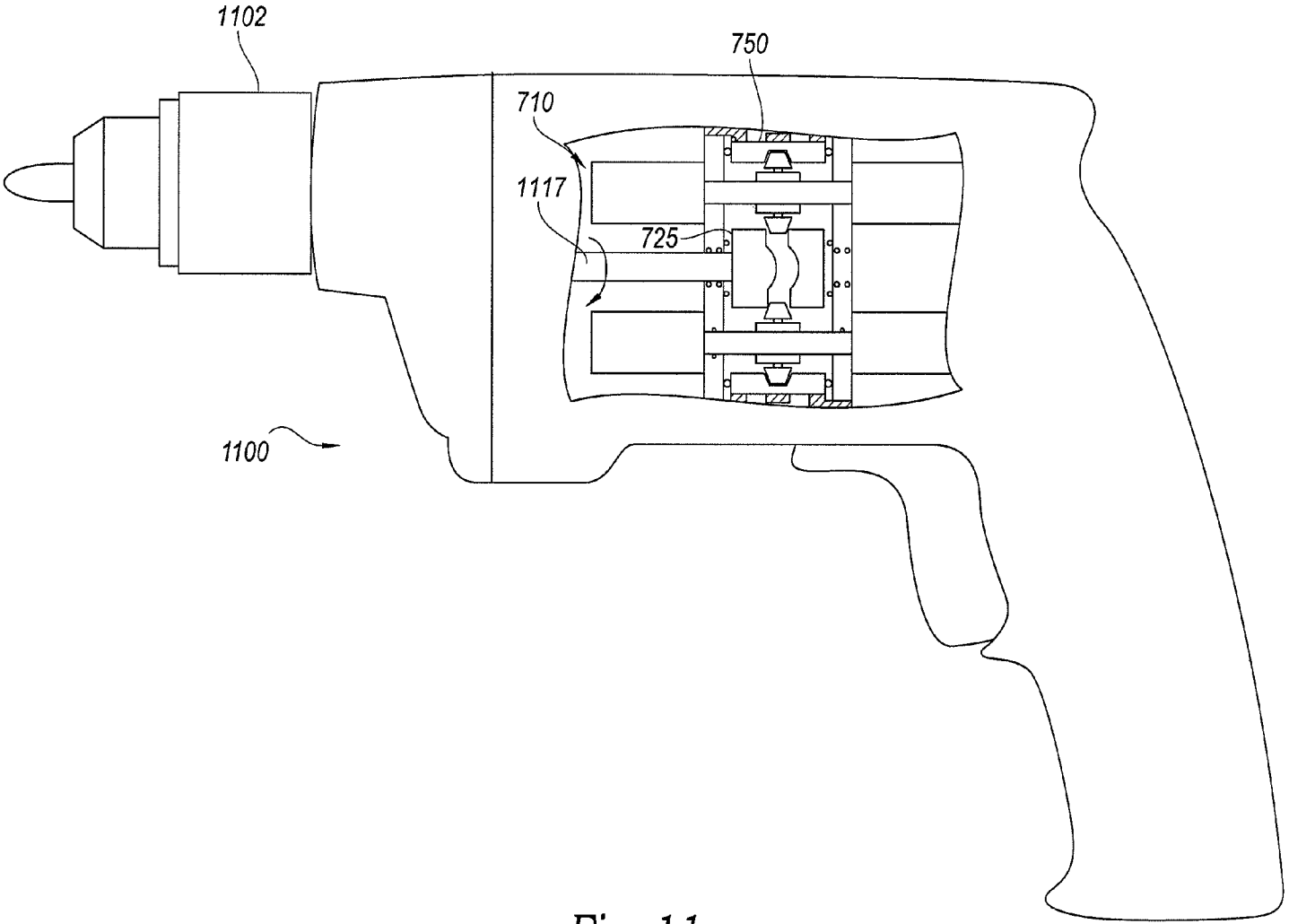

FIG. 11 is a partially cutaway side view of a hand-drill having a counter-rotating engine and configured in accordance with another embodiment of the present disclosure.

DETAILED DESCRIPTION

The present disclosure relates to torque multiplier engines, including counter-rotational engines and rotary driven cam engines. Embodiments in accordance with the present disclosure can include counter-rotational cam drums, translatable cams having varying cross sectional profiles, piston valves and multi-cycle engines. The engines and related technologies described herein can be implemented in automobiles, recreational vehicles, aircraft, boats, ships, power tools, generators and other applications requiring output power or work.

Several embodiments in accordance with the present technology can provide increased efficiency with respect to existing internal combustion engines. The efficiency increase can result in a corresponding reduction in fuel usage and exhaust emissions. Accordingly, the technology disclosed herein can materially contribute to the more efficient utilization and conservation of energy resources and/or materially contribute to greenhouse gas emission reduction.

One aspect of the present disclosure is directed to providing torque multiplication at a desired frequency range, e.g., revolutions per minute (RPM), to reduce engine parts count and complications, and/or to replace a transmission or reduction-gear system. In conventional internal combustion engines, the pistons provide a very limited number of power strokes for each revolution of the crankshaft. For example, a four cylinder four-stroke engine provides two power strokes per revolution of the crankshaft. An eight cylinder four-stroke engine provides an improved, but still limited, four power strokes per revolution. With so few power strokes per revolution, the corresponding torque generated per revolution is low and the engine requires a relatively high RPM and speed reduction subsystem such as a gear train to generate enough torque for most applications. In traditional automobile engines, the resulting crankshaft RPM is too high to be useful in a direct coupling to the wheels. Accordingly, transmissions are used to reduce the RPM to a useful wheel speed. Embodiments of the present disclosure can provide an increased number of power strokes per revolution (torque multiplication) while reducing output RPM. In many applications, this can eliminate the necessity for a transmission.

Embodiments of the present disclosure can provide increased power strokes per revolution through the use of a number of spaced cam lobes or cycle pathways in place of a crankshaft. The spaced cam lobes or cycle pathways can be part of a cam drum or central cam that engages with a piston. The use of a number of spaced cam lobes or cycle pathways can reduce rotational output frequency and provide torque multiplication. Various combinations of internal combustion engines having pistons and thrust-to-rotary converters are described in detail below.

Embodiments in accordance with the present disclosure can include radial pistons, axial pistons, undulated or wave-like swash-plates or various inside diameter or outside diameter cam drums. Additionally, the present technology can include new cycles along with two-stroke and four-stroke engines. Two-stroke engines can be preferable in applications that require a high power-to-weight ratio while four-stroke engines can be preferable in other applications. Although several embodiments and advantages associated therewith are described below in terms of two-stroke engines, these and other embodiments can also be implemented in four-stroke engines.

FIG. 1 is a perspective view of an internal combustion engine 110 having opposing cylinder pairs 111A, 111B; 112A, 112B; 113A, 113B; and 114A, 114B. The engine 110 can include a casing 118, support members 119A and 119B, and an output shaft 117. The casing 118 can enclose internal engine components, and the support members 19 can support the cylinder pairs 111-114. The output shaft 117 can be operably coupled with a cam drum 325.

FIGS. 2 and 3 are partial cutaway top views of a portion of the internal combustion engine 110. The opposing cylinders 111A and 111B include pistons 221A and 221B, respectively. The pistons 221 are operably connected to each other via a rigid rod, e.g., a piston rod or connecting rod 222. Referring to FIG. 3, a carriage 324 is fixedly attached to the connecting rod 222 and a pair of bearings 331 can be operably coupled to the carriage 324. The bearings 331 can engage a tapered channel or groove 330 on a cam drum 325. The tapered groove 330 includes a pair of opposing walls 333A and 333B and a plurality of spaced lobes 333'. In the illustrated embodiment of FIG. 3, the output shaft 117 includes a first side 317A and a second side 317B. The cam drum 325 is fixedly attached to the output shaft 117 and rotatable with the output shaft 117.

Lubrication can be provided to components of the engine 110 in a variety of manners. For example, in one embodiment, spray mist lubrication can be provided to components that contact the cam drum 325 and/or other components by a lubricant pressurization and delivery system (not shown).

FIG. 4 is a perspective view of the cam drum 325 and FIG. 5 illustrates an exemplary pattern of the cam groove 330. Referring to FIGS. 3-5 together, the pistons 221 can travel within the opposing cylinders 111A, 111B and transmit thrust to the bearings 331 on the carriage 324 of the connecting rod 222. The bearings 331 are driven against the opposing walls 333A and 333B and generate torque on the cam drum 325 which translates linear motion of the opposing pistons into rotational motion of the cam drum 325. The torque rotates the cam drum 325 and the attached output shaft 117. The pattern of the cam groove 330 with the lobes 333' can correspond to a relatively large number of power strokes per revolution of the output shaft 117. The high frequency of the power strokes by the opposing pistons 221, and the resulting frequent impartation of angular momentum throughout each rotation of the cam drum 325, can produce an essentially constant rotational speed for the output shaft 117. The constant speed can provide for a smoother and more efficient operation of an engine incorporating the features described herein.

The spaced cam lobes 333' that form the cam channel 330 can provide torque multiplication by enabling a greater number of power strokes per revolution of the output shaft 117. For each revolution of the output shaft 117, each cam lobe 333' corresponds to the movement of each piston from top dead center (TDC) to bottom dead center (BDC) within its corresponding cylinder. Hence, a two-stroke engine produces one piston cycle for every two cam lobes 333' during one rotation of the cam drum 325. Therefore, because each piston cycle produces one power stroke, the number of power strokes per revolution of the cam drum 325 is equal to one-half the number of cam lobes multiplied by the number of cylinders. Similarly, the RPM of the output shaft 117 and of the cam drum 325 is equivalent to the piston cycle frequency divided by one-half the number of cam lobes 333'. For example, six equally spaced cam lobes 333', with three on each side of the channel 330 (as shown in FIG. 5), result in a cam rotation equal to one-third the piston frequency.

The design of the engine 110 (FIG. 3) with the opposing pistons 221 and connecting rod 222 provides offsetting forces that balance and therefore do not produce side loads on the pistons 221. Engines incorporating this design can operate at relatively high piston frequencies, e.g., 13,500 complete two-stroke cycles per minute. This can produce very high torque along a wide range of output shaft speeds (e.g., from about 30 RPM up to about 1,500 RPM). In some embodiments the cam lobes 333' can be equally spaced (see FIG. 5) to produce balanced operation. For example, balanced operation can be achieved by combining an odd number of equally spaced cam lobes on each side of the channel 330 with equally spaced opposing cylinders amounting to the sum of the number of cam lobes plus two.

Table 1 lists some illustrative combinations for various embodiments and illustrates the relationship between the number of cam lobes, cylinders, opposing cylinder pairs, and the resulting number of power strokes per revolution of the output shaft. Additionally, Table 1 includes a multiplication index associated with a given number of cam lobes. Although Table 1 is based on the operation of a two-stroke engine, four-stroke engines in accordance with the present disclosure provide similar torque multiplication benefits. Additionally, although the illustrative embodiments of Table 1 include engines having a number of cylinders equal to the number of cam lobes plus two, other embodiments can have different configurations (e.g., 12 cam lobes and 8 cylinders).

TABLE 1

| CAM LOBES | MULTI-PLICATION INDEX | CYLINDERS | CYLINDER PAIRS | POWER STROKES/ REV |
|---|---|---|---|---|
| 2 | 1 | 4 | 2 | 4 |
| 6 | 3 | 8 | 4 | 24 |
| 10 | 5 | 12 | 6 | 60 |
| 14 | 7 | 16 | 8 | 112 |
| 18 | 9 | 20 | 10 | 180 |
| 22 | 11 | 24 | 12 | 264 |

The torque multiplication provided by the present technology can provide increased output torque by an engine having a similar or smaller overall size. For example, a conventional 8 cylinder two-stroke engine utilizing a crankshaft produces eight power strokes per revolution. As shown in Table 1 above, an 8 cylinder engine configured in accordance with the present technology provides three times the number of power strokes per revolution (24 power strokes). In many applications, several embodiments can produce the increased torque without requiring a transmission.

In certain applications (e.g., elevators, conveyer drives, transit buses, and locomotives), smooth, high torque and low speed operation is required. In these and other applications, a greater number of opposing cylinders can be employed. For example, one embodiment can include twenty cylinders arranged as ten opposing, equally-spaced pairs which are axially parallel and spaced at equal radial distances from the central output shaft 117. This balanced arrangement with eighteen cam lobes provides 180 power strokes per revolution of the output shaft with opposing power strokes every 4° of rotation. In other applications having large power requirements, an engine having 24 cylinders and 22 cam lobes can provide 264 power strokes per revolution of the output shaft, as shown in Table 1 above.

In applications having large inertia loads, such as in commercial garden equipment, trucks, farm tractors, and commercial marine drives, it can be advantageous to use 8, 12 or 16 cylinder arrangements. In applications with smaller inertia loads, such as in small automobiles, recreational marine propulsion, and light trucks, it can be advantageous to use 8 or fewer cylinders. For example, engines utilizing 8 cylinders and 6 cam lobes can provide a torque multiplication index of three and a very compact, smooth running, light-weight power package. Motorcycles, chain saws, lawnmowers and other vehicles and/or devices can also utilize this configuration.

In some applications it can be preferable to have high torque production along with functional vibration, e.g., for impact drills, sanders, etc. Additionally, in equipment such as plows, scrapers, graders, and loaders, vibration can be beneficial in reducing the amount of drag and/or work requirements for moving the earth and/or for breaking up compacted or solid materials. In one embodiment, an odd number of cylinder pairs can produce an unbalanced operation that produces functional vibrations. For example, 3, 5, 7, or 9 cylinder pairs provide engines with 6, 10, 14, and 18 cylinders that can produce useful vibration characteristics in addition to high-torque operation. In another embodiment, the cam groove 330 can have an irregular shape and/or the cam lobes 333' can be spaced at uneven intervals to produce functional vibrations. As with the other embodiments described herein, these embodiments can be provided with an appropriate number of cam lobes 333' to meet the torque multiplication requirements for the particular application.

In several applications, including those with large inertia loads, the output shaft 117 can be coupled to a load through a suitable clutch or clutches that allow the engine to achieve the needed shaft speed and torque before being coupled to the load. The clutch can de-couple the engine from the load and provide a gradual coupling, during which the inertia of the load can be overcome. The clutch can subsequently "sync" the engine speed and the load speed. In applications that require differing load speeds for two or more loads, multiple clutches can be provided to sync the individual loads. For example, in automobiles multiple clutches can provide coordinated turning speeds while providing power to each wheel. Similarly, a twin propeller boat can provide alternate speeds for each of the propellers through the use of clutches.

In some applications, a clutch alone may be insufficient or impractical for starting a large inertia load and/or for matching output shaft speed to load speed. Accordingly, in some embodiments a transmission having multiple gears can be provided to assist with starting and/or varying load speeds. Several embodiments can include clutches, transmissions and/or torque converters that are suitable for meeting the needs of a wide variety of applications and can include mechanical, electromagnetic, hydraulic, ferromagnetic, and/or pneumatic operation. In automobiles, the two output shaft sides 317A and 317B (FIG. 3) can each be coupled to a suitable clutch or transmission to couple the engine to the drive wheels.

FIGS. 6A and 6B are cross-sectional views of the cylinder 111A with the piston 221A TDC and BDC, respectively. The cylinder 111A includes a combustion chamber 602, and may include a precompression chamber 601 an inlet port 603, an outlet port 605 and a transfer passage 604. An intake valve 606 can be operably coupled to the connecting rod 222 and a combination fuel injector and spark mechanism or fuel injector module 607 can be positioned to be in contact with the combustion chamber 602. The fuel injector module 607 can be a component of a fuel injector ignitor system that includes fuel lines, pumps, electrical cabling, and/or other components associated with fuel injection and/or ignition or spark generation. In operation, intake air flows through the intake port 603, past the intake valve 606 into the precompression chamber 601 as shown in FIG. 6A. During the power stroke, the piston 221 travels downwardly in the cylinder 111A causing the air in the precompression chamber 601 to flow into the passage 604 and develop transfer momentum. As the piston 221A continues through the power stroke, the exhaust port 605 is exposed, allowing exhaust gases to exit the combustion chamber 602. As the piston continues to BDC (FIG. 6B) the transfer passage 604 is exposed to the combustion chamber 602 and air flows into the combustion chamber 602 causing combustion products to sweep into the exhaust port 605. The displacement of air from the precompression chamber 601 into the combustion chamber 602 through the passage 604 can improve efficiency of the piston 221A by decreasing the resistance to the travel of the piston 221A.

After reaching BDC, the piston 221A reverses direction and moves upwardly in the cylinder 111A past the transfer passage 604 and the exhaust port 605 (FIG. 6A). The inlet valve 606 can include a friction gland 608 or can be operated by a magnet, such as a permanent magnet (not shown), on connecting rod 222. As the piston 221A travels upward, the valve 606 moves with the connecting rod 222 through the action of the friction force from the friction gland 608 or from attraction of the magnet to the valve 606. After the valve 606 is fully opened, the connecting rod 222 can continue to move upwardly while the valve 606 remains static. When the piston 221A returns to BDC, the valve 606 is closed by similar action of the friction gland 608 or magnet.

A fuel injector (not shown), can be positioned to spray fuel through the passage 604 into the combustion chamber 602. Spraying fuel in the direction of the air flow into the combustion chamber 602 can impart momentum to the entering air and cool the air to improve the breathing efficiency of the intake system and result in greater air delivery to the combustion chamber 602. In some embodiments, power production and fuel economy can be increased by producing an overall air fuel mixture that is too lean to be ignited by a spark discharge and instead causing ignition by invading the lean mixture with combusting fuel that is injected and ignited by the fuel injector module 607.

Control of the fuel injector module 607 can be accomplished with a control circuit in which the angular location of the cam drum 325 (FIG. 3) is sensed by electronic or electro-optical devices. The control circuit can operate a solenoid valve in the fuel injector module 607 to control fuel flow to a spray nozzle. The circuit can also control the discharge of current across a gap in the fuel injector module 607. The control circuit may use phototransistors, photodiodes, and photo resistors in conjunction with light-emitting or reflecting strips or other non-contact sensors, such as proximity capacitance effect devices to achieve wear-free operation.

The fuel injector module 607 can improve fuel economy by providing stratified-charge combustion of fuel within excess air in the combustion chamber 602. Fuel entering the combustion chamber 602 can be ignited by passage of a spark through fuel-rich zones that are produced within excess air. In this mode, assured ignition of very lean overall air fuel mixtures of 40:1 to 400:1 are possible. The stratified-charge combustion of the lean mixture can provide excess air between the combustion zone and the cylinder walls. The excess air can act as insulation, minimizing heat transfer to the cylinder walls. Fuel economy can be further increased by not injecting fuel during deceleration of the engine. Additionally, several embodiments in accordance with the present technology can be started without a starter by injecting fuel into cylinders with the pistons in the power stroke position and igniting the fuel. This feature can increase fuel economy by providing the ability to economically and readily stop and start the engine, e.g., at stop lights or signs and in stop-and-go situations.

In some embodiments, packing material having a high surface area, such as stainless steel wool, can be positioned in and beyond the exhaust passage 605 to remove heat from the exhaust gases and transfer the heat to air entering the combustion chamber. This regenerative heating of intake air can reduce the heat needed for fuel combustion and increase the kinetics of combustion in the combustion chamber. In high compression ratio embodiments of the invention, the compressed air can reach temperatures sufficient to cause ignition of injected fuel. In lower compression ratio embodiments the fuel can be ignited by a spark discharge, a hot surface, a glow plug, or a catalytic surface.

FIG. 7A is a partially schematic cross-sectional side view of an internal combustion engine 710 configured in accordance with another embodiment of the disclosure, and FIG. 7B is a partially schematic cross-sectional end view along the line 7B of the internal combustion engine 710 of FIG. 7A. Referring to FIGS. 7A and 7B together, the internal combustion engine 710 can include one or more pairs of opposing cylinders 711-714 (identified individually as opposing cylinder pairs 711A, 711B; 712A, 712B; 713A, 713B; and 714A, 714B). Reciprocating pistons (not shown in FIGS. 7A and 7B) are operably positioned in the opposing cylinders 711-714, and are coupled together by corresponding piston rods or connecting rods 722. Accordingly, as one piston moves toward the BDC position, the opposing piston moves toward the TDC position.

The cylinders 711-714, pistons, ignition system, and other systems associated with the engine 710 can be at least generally similar in structure and function to the corresponding components and systems of the engine 110 described in detail above with reference to FIGS. 1-6B. For example, the engine 710 includes a central cam drum or inner cam drum 725 having a cam groove 730 (e.g., a sinuous cam groove) that receives a plurality of inner rotatable members 731A (e.g., a roller or bearing), each of which is coupled to a corresponding one of the connecting rods 722. As explained in detail above, coupling the opposing pistons to the inner cam drum 725 in the forgoing manner translates the thrust from the opposing pistons into rotation of the inner cam drum 725. The inner cam drum 725 can be fixedly or otherwise coupled (e.g., via clutches) to a first drive shaft 717A and a second drive shaft 717B. In the illustrated embodiment, the first and second drive shafts 717A, 717B are coaxial with the inner cam drum 725 and parallel to the direction of piston motion. In other embodiments, the first and second drive shafts 717A, 717B can be operably coupled to the inner cam drum 725 with a constant-velocity joint, or other coupling mechanism, and can extend at an angle from the rotational axis of the inner cam drum 725. In still other embodiments, the inner cam drum 725 can be attached to a single drive shaft that extends from one or both sides of the cam drum 725.

In the illustrated embodiment, the cam groove 730 has a width greater than a width of the bearings 731A. The difference in width can create a gap between the bearings 731A and the cam groove 730. The gap allows the bearings 731A to rotate in one direction as the connecting rod 722 drives the bearings 731A in a first direction, and to rotate in the same or an opposite direction as the connecting rod drives the bearings 7.31A in a second direction. Although the illustrated embodiment includes only one bearing 731A engaged with the cam groove 730 for each connecting rod 722, in other embodiments the internal combustion engine 710 can include two bearings 731A engaged with the cam groove 730 for each connecting rod 722. In such embodiments, the bearings 731A can operate in the manner described above with respect to FIGS. 1-6B.

In one aspect of the illustrated embodiment, the internal combustion engine 710 includes an outer cylindrical rotor or outer cam drum 750 coaxially disposed relative to the inner cam drum 725. The outer cam drum 750 can be rotatably supported by suitable thrust bearings 752 carried on opposing support members 719A, 719B, and/or suitable roller bearings 754. The outer cam drum 750 can include a cam groove 751 (e.g., a sinuous cam groove) in an inner surface thereof. The cam groove 751 can include a plurality of appropriately spaced and shaped peaks or cam lobes. The cam groove 751 movably receives a plurality of outer rotatable members or bearings 731B, each of which is operably coupled to a corresponding connecting rod 722. Accordingly, in the illustrated embodiment, linear back and forth motion of the pistons during operation of the engine 710 drives the bearings 731A, 731B back and forth, which in turn drives the inner cam drum 725 and the outer cam drum 750 in rotation about the central axis of the engine 710.

In the illustrated embodiment of FIG. 7A, the support member 719B includes a valve or an opening 775 (shown schematically). The opening 775 can provide ventilation and/or an intake and exhaust path for the engine 710, as will be described further below. Additionally, a heat exchanger or other regenerative heat transfer device can be operably coupled to the opening 775 to utilize the heat energy of the exhaust.

In one embodiment, the inner cam drum 725 can rotate in a first direction and the outer cam drum 750 can rotate in an opposite direction to provide a counter-rotating engine. Counter-rotation can reduce the overall angular momentum generated by the engine 710, and accordingly, can reduce the force necessary to change the orientation of the engine 710. For example, when mounted in an automobile the engine 710 can improve handling by reducing the force necessary to turn the vehicle. Additionally, the engine 710 can reduce the torque exerted on associated motor mounts or similar mounting structures. In another embodiment, the inner cam drum 725 and the outer cam drum 750 can rotate in the same direction.

In one aspect of the illustrated embodiment the first and second drive shafts 717A, 717B can be operably coupled to a first and a second load to provide mechanical power, while a third drive shaft 721 can be operably coupled to a third load. More specifically, the outer cam drum 750 can include a plurality of gear teeth 760 extending around an outer perimeter thereof (FIG. 7B). The teeth 760 can be positioned to engage corresponding teeth on a gear 762. The gear 762 is operably coupled to the third drive shaft 721, which can be operably coupled to various devices for doing useful work. In the illustrated embodiment, a propeller 764 is operably coupled to the third drive shaft 721 to provide thrust to, e.g., a watercraft such as a boat. In another embodiment, the outer cam drum 750 can be operably coupled to an electric generator. The electric generator can provide electrical power for a hybrid or other type of vehicle power system. For example, the electric generator can be electrically coupled to a battery that can store the generated electricity and be used to operate an electric motor.

In a further embodiment of the present technology, the inner cam drum 725 and/or the outer cam drum 750 can be fitted with components of an electricity generator, such as permanent magnets (not shown), and provide electrical generation capabilities. The permanent magnets can produce alternating magnetic poles and create an alternating electromotive force (EMF) in an insulated winding (not shown) during rotation. The generated electricity can be used for lighting, powering a variety of electrical devices and/or a variety of other suitable purposes. Additionally, the cam drums 725, 750 can provide regenerative braking to convert the kinetic energy of the vehicle into electrical energy. The electrical energy generated by the cam drums 725, 750 can be stored in a flywheel, a battery or as hydrogen through electrolysis of a suitable electrolyte (e.g., water and potassium hydroxide).

In other embodiments one or more pistons or connecting rods can be provided with capacitive electric charge bands and/or permanent- or electro-magnets to participate as linear motion electricity generators. Illustratively, such arrangements can provide moving electrical and/or magnetic poles and create an alternating electromotive force (EMF) in an insulated circuit such as a winding (not shown) during motion. The generated electricity can be used for lighting, powering a variety of electrical devices and/or a variety of other suitable purposes.

In several embodiments, engines in accordance with the present technology can incorporate features to improve the thermal characteristics of the engine. For example, in adiabatic combustion chambers with heat dam applications the top of the piston can be thermally isolated with suitable insulation, e.g., ceramic fiber paper and/or ceramic felt. The cylinder liner and the head liner can be similarly insulated with ceramic, such as pour stone. In another embodiment, the piston can include a heat retaining piston cup to substantially insulate the combustion process from the cylinder wall. The pistons, cylinders, and/or other engine components can include materials suitable for providing long life by resisting thermal shock, fatigue, oxidation, scaling and/or other destructive processes. These materials can include various ceramics, cermets and/or superalloys containing iron, nickel, and/or cobalt.

FIGS. 8A and 8B are schematic front views of internal combustion engines 810A and 810B, respectively, configured in accordance with another embodiment of the disclosure. Referring first to FIG. 8A, the engine 810A includes a plurality of cylinders 808 and corresponding pistons 802 arranged in a radial configuration about a central, thrust-to-rotary conversion cam 804A ("cam 804A"). Although a six cylinder arrangement is illustrated in FIG. 8A, in other embodiments internal combustion engines configured in accordance with the present disclosure can include 3, 4, 5, or more cylinders.

In the illustrated embodiment, each of the cylinders 808 can include a suitable fuel injector module 810 for injecting fuel into a combustion chamber 820 and igniting the fuel at appropriate times during the engine cycle. The fuel injector module 810 can be at least generally similar in structure and function to one or more of the fuel injector modules described in detail above and/or in the various patents and/or patent applications incorporated herein by reference. The engine 810A can operate in both two and four-stroke modes depending on the particular configuration. For example, the engine 810A can include one or more valves 803 and 805 for admitting air into the combustion chamber 820 and/or allowing exhaust products to exit the combustion chamber 820 at appropriate times during a four-stroke engine cycle. In addition or alternatively, the engine 810A can function as a two-stroke engine by means of an air intake 806 in the cylinder 808 which can communicate with the combustion chamber 820 by means of a suitably timed piston port 807 and transfer port 809. The engine 810 can additionally include a second transfer port 821 and a second piston port 823 for transfer of, for example, exhaust products from the combustion chamber 820. As those of ordinary skill in the art will appreciate, the various valves, transfer ports and piston ports described above can be utilized in various combinations and arrangements to operate the engine 810A in both two and four-stroke configurations. Accordingly, the technology disclosed herein is not limited to use with a particular type of engine cycle or configuration.

In the illustrated embodiment, each piston 802 is operably coupled to the cam 804A by means of a corresponding roller bearing 811 that acts as a cam follower. The cam 804A rotates about a central axis 824, and can include a plurality of (e.g., five) cam lobes 822A. The number, spacing and profile of the cam lobes 822A dictate the timing and motion of the pistons 802.

In operation, the cam 804A rotates about the central axis 824 causing the pistons 802 to reciprocate in the cylinders 808 by means of the cam lobes 822A. In either two or four-stroke operation, the downward force on the piston 802 during the power stroke drives the corresponding roller bearing 811 against the side portion (e.g., the left side portion) of the corresponding cam lobe 822A, which in turn converts the axial thrust of the piston 802 into rotation of the cam 804A. Continued rotation of the cam 804A causes the next cam lobe 822A to drive the roller bearing 811 upward, causing the piston 802 to move upwardly in the cylinder 808 in an exhaust stroke (four-stroke cycle) or an exhaust/compression stroke (two-stroke cycle). In some embodiments, for example, embodiments having high cam speed or aggressive cam profiles, the roller bearings 811 can be rollably engaged with the surface of the cam 804A to positively control piston motion throughout the cycle. Such positive control can be accomplished by means of, for example, a magnet, positive cam engagement via, e.g., a roller bearing/flange arrangement, and/or by maintaining suitable pressure in the combustion chamber 820. In addition, the roller bearing 811 can be coupled to the piston 802 by means of a suitable spring or other shock absorbing mechanism if desired or necessary to attenuate the shock on the engine components resulting from, for example, the profile and/or frequency of the cam lobes 822A.

The engine 810A illustrates one embodiment of a suitable torque multiplier engine configured in accordance with the present disclosure. In one aspect of this embodiment, and not wishing to be bound by theory, such as two or four-stroke operation, it is believed that the torque output on the cam 804A (and associated drive shaft) can be increased by increasing the number of power strokes of any operating cycle, that is, by increasing the number of cam lobes 822A. Accordingly, to provide an engine with relatively high torque per unit of displacement, the cam 804A should tend to have a higher number of cam lobes (e.g., 5 or more). Conversely, to provide lower torque but perhaps a higher revving engine, the cam 804A would have fewer cam lobes. For example, as shown in FIG. 8B, the engine 810B is generally similar in structure and function to the engine 810A, with the exception that the cam 804B includes three cam lobes 822B instead of the five cam lobes 822A of FIG. 8A.

FIG. 8C is a perspective view of the cam 804A of FIG. 8A. The cam 804A has a varying profile along the central axis 824 with a first diameter D1 at a first end 851 of the cam 804A and a second diameter D2 at a second end 852 of the cam 804A. In the illustrated embodiment, the second diameter D2 is greater than the first diameter D1. Referring to FIGS. 8A and 8C together, in one aspect of the illustrated embodiment the cam 804A can be translated back and forth along its central axis 824 (e.g., into or out of the plane of the paper in FIG. 8A) by a suitable mechanism to increase or decrease the corresponding profile of the cam lobes 822A as desired. More specifically, the cam lobes 822 vary in height along the length of the cam drum 804A (i.e., parallel to the central axis 824), as shown in FIG. 8C. Accordingly, the cam lobes 822A can provide a greater lift when the cam 804A is in a first position, and a lower lift as shown by cam lobes 822A' when the cam drum 804A translates along the central axis 824 to a second position 804', as shown in FIG. 8A. This feature enables the engine 810A to vary the compression ratio (and/or timing) in the combustion chamber 820 in real time and on demand as desired to vary, for example, the torque, power output, fuel consumption, and/or other performance characteristics of the engine 810A.

FIG. 8D is a perspective view of the cam 804B of FIG. 8B. Similar to the cam 804A, the cam 804B has a varying profile along the central axis 824. In a manner comparable to that described above with respect to the cam 804A, the cam lobes 822B provide a variable lift due to a varying height along the axis 824. Accordingly, the cam lobes 822B provide a greater lift in a first position and a lower lift in a second position 804B', as shown in FIG. 8B.

FIG. 8E is a perspective view of a cam 853 having three lobes 855 at a first end 857 and five lobes 859 at a second end 861. The cam 853 can be positioned in a radial engine in a manner similar to the cams 804A and 804B described above. The cam 853 can translate along the radial axis 824 and can provide varying lift in a manner similar to that described above. The illustrated embodiment can also provide varying torque multiplication by shifting from three cam lobes 855 to five cam lobes 859. A section 863 of the cam 853 may have a generally circular or circular cross-section that can disengage for "free-wheeling" and/or assist in shifting operation between the three cam lobes 855 and the five cam lobes 859. Although the illustrated embodiments of FIGS. 8A-8E provide examples of cams having three and five lobes, other embodiments can a have different numbers of cam lobes and differing cross-sectional shapes.

Figure 9B:
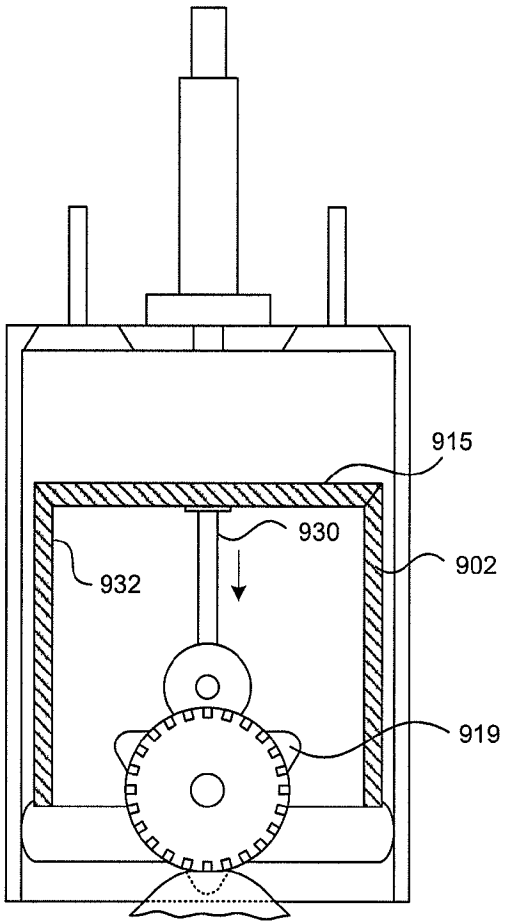
Figure 9A:
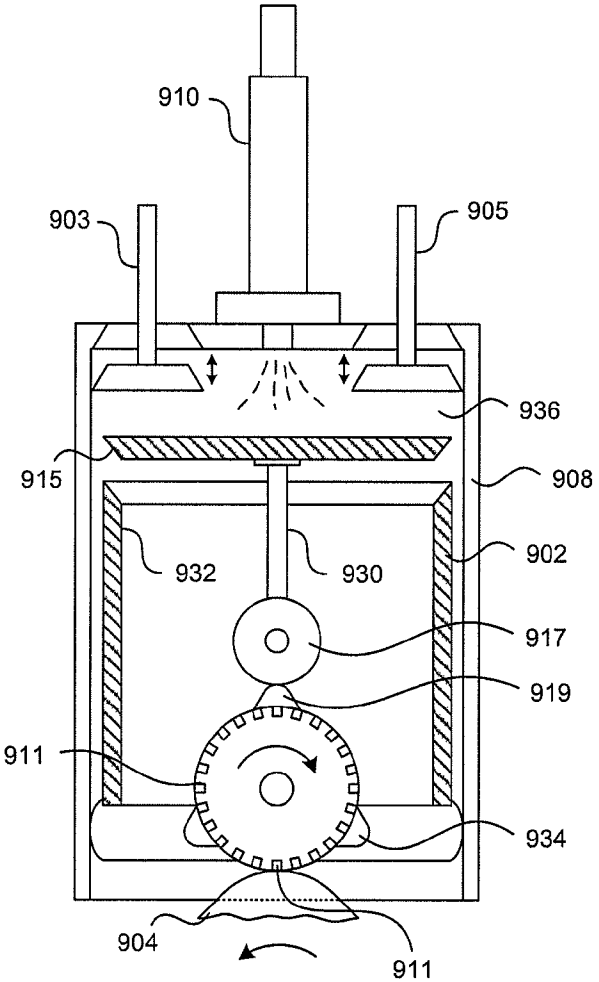

FIGS. 9A and 9B are partially schematic side views of a cylinder 908 having a piston 902 in accordance with an embodiment of the disclosure. The piston 902 includes a piston valve 915, shown in an open and a closed position in FIGS. 9A and 9B, respectively. Referring to FIGS. 9A and 9B together, the piston 902 includes a sidewall 932 and operates in the cylinder 908 of an internal combustion engine, such as the radial engines 810A, 8108 described above with reference to FIGS. 8A and 8B or the counter-rotating engine 710 described above with reference to FIGS. 7A and 7B. Accordingly, the piston 902 can be operably coupled to a main or central cam 904 by means of a roller bearing 911. As the piston 902 moves downwardly in the cylinder 908, the piston 902 drives the cam 904 in rotation about its central axis by means such as the roller bearing 911.

In the illustrated embodiment, at least a portion of the piston top is formed into the piston valve 915 which can periodically lift off of the piston sidewall 932 during operation of the engine to provide an annular gap therebetween. The piston valve 915 is operably coupled to a roller 917 by means of a valve stem 930 or other suitable member. The roller 917 rolls on an outer surface of a valve cam 919. In the illustrated embodiment, the valve cam 919 includes three cam lobes 934. In other embodiments, however, the valve cam 919 and variations thereof can include features of a crank shaft or a cam shaft with more or fewer cam lobes as necessary or desirable depending on the particular application and engine configuration. The valve cam 919 and the roller bearing 911 are fixedly coupled to a central shaft. As a result, when the roller bearing 911 is driven in rotation by means of the main or central cam 904, the valve cam 919 also rotates. Rotation of the valve cam 919 drives the valve 915 upwardly and downwardly relative to the piston sidewall 932 at appropriately selected times during engine operation to enable gasses and/or other fluids to flow into or out of a combustion chamber 936 past the valve 915 and facilitate the combustion process. For example, the piston Valve 915 can provide a decreased or increased compression ratio during appropriate portions of the piston cycle to improve fuel economy.

In addition to the foregoing features, the cylinder 908 can also include one or more valves (e.g., an intake valve 903 and/or an exhaust valve 905) for admitting air and/or other intake charges into the combustion chamber 936, and/or for exhausting combustion products from the combustion chamber 936 at appropriate times during operation of the engine. The cylinder 908 can carry a fuel injector module 910 that can be at least generally similar in structure and function to the fuel injector modules described above for injecting fuel into the combustion chamber 936 and igniting the fuel at the appropriate or desired times.

The cylinder 908 can operate in a four-stroke cycle with the valves 903 and 905 opening and closing in a conventional four-stroke sequence. However, the cam 919 can open the piston valve 915 during the exhaust stroke to facilitate purging exhaust products from the combustion chamber 936. More specifically, the piston valve 915 can be closed as shown in FIG. 9B during the compression and power strokes, and opened as shown in FIG. 9A during at least a portion of the exhaust stroke.

Figure 9D:
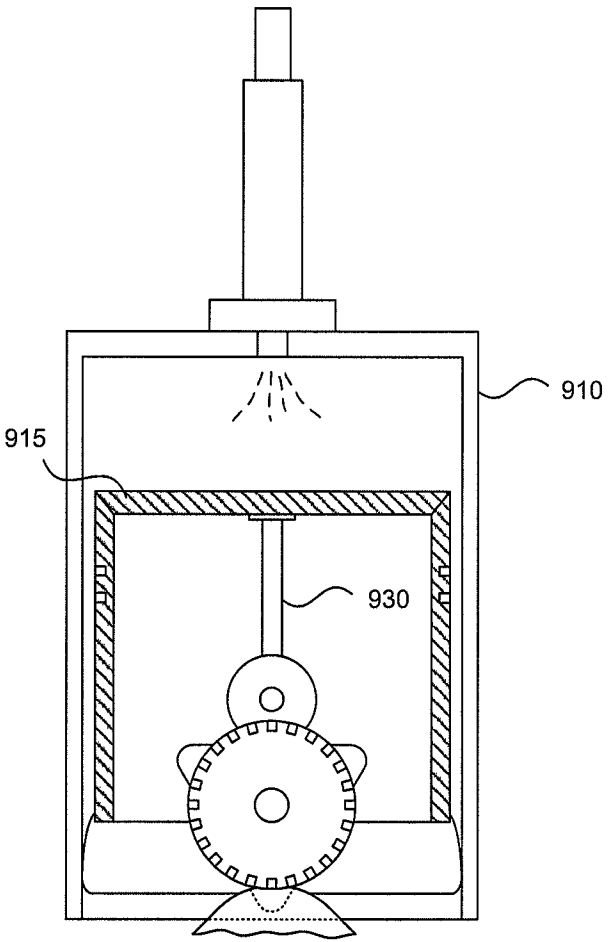
Figure 9C:
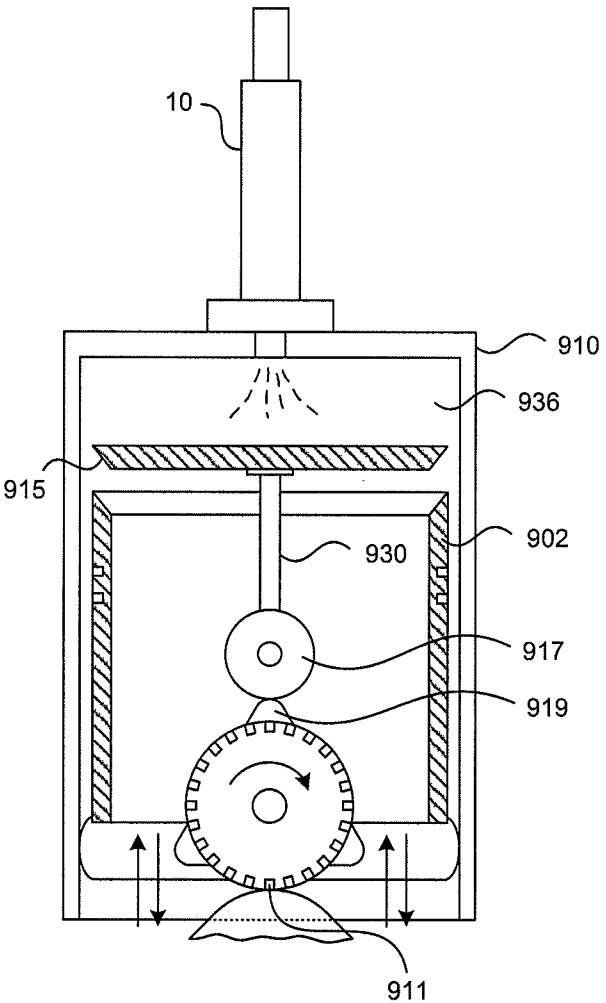

The cylinder 908 can also be configured to operate in a two-stroke cycle with a piston having a piston valve. FIGS. 9C and 9D are partially schematic side views of a cylinder 910 having the piston 902 in accordance with an embodiment of the disclosure. In the illustrated two-stroke embodiment, the intake and, exhaust valves 903 and 905 (FIG. 9A) are absent. In operation, the piston valve 915 can start to open as the piston 902 moves downwardly during a portion of the power stroke toward the BDC position. As shown in FIG. 9C, this enables exhaust products to exit the combustion chamber 936 around the open piston valve 915 and through the piston 902 while subsequently allowing fresh air to flow into the combustion chamber 936 past the piston valve 915. In one aspect of this embodiment, the associated engine casing can maintain a constant or at least generally constant flow of fresh air to purge the exhaust products from the engine and provide fresh air for use in the combustion process. The engine casing can be provided with openings, a valve or a series of valves to provide air flow, e.g., the opening 775 (FIG. 7A). In this embodiment, the piston valve 915 can remain at least partially open during a portion of the upward piston stroke toward TDC to continue purging the combustion chamber 936 through the ventilated casing. The piston valve 915 can close during the compression stroke to provide suitable compression in the combustion chamber 936 for ignition and expansion, as shown in FIG. 9D.

In some embodiments, the piston valve 915 can be opened and closed by the action of an intermittent axial latching mechanism that includes a conical compression spring (not shown) that urges the piston valve 915 closed. The piston valve 915 can be constructed from a carbon fiber reinforced composite with a substantial portion of the fibers extending from the valve stem into the valve head to provide longitudinal strength and stability. Additionally, the connecting rod or other components can be made from ceramics such as stabilized zirconia, alumina, silicon nitride, and/or carbon fiber reinforced composites. A spherical rod end of the connecting rod can be housed within a spherical socket of the piston. This can provide angular and radial alignment freedom to reduce friction. A carbon fiber reinforced sleeve, which is fitted within a carbon fiber reinforced cylinder, can further reduce friction. Relative motion components may incorporate air, water, or steam bearings or operate as dry assemblies.

Illustratively, combustion of typical hydrocarbons such as a gallon of gasoline produces about a condensable gallon of water. Such water can be cooled sufficiently to condense by rejection of heat to marine or air environments, preheating the oxidant, and/or by thermochemical regeneration and utilized in bearings including phase change bearings. Steam emitted from application of such water bearings is not an objectionable environmental contaminant and can be utilized in various applications to reduce pollution. In one embodiment a monovalve admits oxidant to a combustion chamber and after combustion admits products of combustion to the environment. This may be in conjunction with heat recovery in which exiting products of combustion heat an oxidant and/or fuel and/or for endothermic thermochemical regeneration to convert easily stored fuels such as ammonia or urea, or hydrocarbons such as propane or butane to hydrogen and carbon monoxide as generally shown in Equation 1.

$$\text{HEAT}+C_xH_y+xH_2O \rightarrow x\text{CO}+[x+0.5y]H_2 \qquad \text{Equation 1.}$$

Equation 2 shows the process for thermochemical regeneration of ammonia. In such applications the products of combustion such as water and nitrogen do not contaminate the environment with any carbon compounds.

$$\text{HEAT}+2NH_3 \rightarrow N_2+3H_2 \qquad \text{Equation 2.}$$

Piston valves (e.g., the piston valve 915) and corresponding valve cams (e.g., the valve cam 919), can be utilized with various embodiments of the torque multiplier engines described herein. For example, the piston valve 915 and/or the valve cam 919 can be implemented in the engine 110 of FIG. 1, the engine 710 of FIG. 7A, the engine 810A of FIG. 8A and/or the engine 810B of FIG. 8B. Although the implementation of the piston valve 915 and the valve cam 919 in various embodiments described herein represent particular combinations of the disclosed technology, the embodiments described herein can be combined in a multitude of other suitable manners. Accordingly, although certain embodiments include certain features while not including other features, it is within the scope of the present disclosure to combine the features of the various embodiments in any of a variety of suitable combinations.

The inherent balance and torque-multiplying features of the engines disclosed herein can allow an engine to be placed between the driven wheels of a vehicle and greatly simplify the drive train. FIG. 10 is a partially cutaway overhead view of a portion of an automobile having the counter-rotating engine 710 in accordance with an embodiment of the present technology. In the illustrated embodiment, the counter-rotating engine 710 is positioned between the right front wheel 1002 and the left front wheel 1004. The drive shafts 717A and 717B are directed to the right front wheel 1002 and the left front wheel 1004, respectively. Transmissions or clutches 1006 can be positioned between the engine 710 and the wheels 1002, 1004. The clutches 1006 can provide for varying rotation rates of the wheels during cornering and/or provide varying application of power to optimize handling or stability. Additionally, the clutches 1006 can allow the engine 710 to develop sufficient torque before the lock up of the drive shafts 717A, 717B to the wheels 1002, 1004.

The counter-rotating engines of the present disclosure can be combined with several devices to deliver power to the wheels of vehicles and/or to generators or other loads. Accordingly, although embodiments described above include counter-rotating engines having two or more drive shafts and the use of clutches or transmissions to control power distribution to wheels, other embodiments can employ single drive shafts in combination with differentials or other devices to control power output to a load such as a compressor or to the wheels of a vehicle. Additionally, the first drive shaft can be directed to a differential or other power distributing device to provide power to a first pair of wheels, while the second drive shaft can be directed to provide power to a second pair of wheels. Furthermore, the outer cam drum can provide power to the wheels and/or a generator. Accordingly, various combinations of the drive shafts and the outer cam drum can provide power to wheels, generators, or other loads on a vehicle.

FIG. 11 is a partially cutaway side view of a hand-drill 1100 having the counter-rotating engine 710 configured in accordance with another embodiment of the present disclosure. In the illustrated embodiment, the counter-rotating engine 710 includes an output shaft 1117 operably coupled to a drill chuck 1102 through gears (not shown). The counter rotating cam drums 725, 750 of the hand-drill 1100 can allow operation at high RPMs, and yet not incur the negative effects of angular momentum that would be inherent with a device having a single rotating component. In hand tools this can be particularly important to reduce the fatigue an operator experiences when using the tool Although the illustrated embodiment of FIG. 11 includes the counter-rotating engine 710 in the hand-drill 1100, the counter-rotating engine 710 can provide similar benefits when installed in a variety of power tools, e.g., hand saws, reciprocating saws, etc. Additionally, in embodiments where the counter-rotating engine 710 is configured to run on a hydrogen fuel source, the lack of harmful emissions can allow the associated power tool to be operated indoors and in environments that require a high level of cleanliness or sterility. For example, the counter-rotating engine 710 can be utilized in dental or medical tools including saws, drills, and other medical power tools. Additionally, when run on a hydrogen fuel source, in addition to not producing harmful emissions, the counter-rotating engine 710 can clean the air by removing particulates and/or other unwanted contaminants form the air through the combustion process.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. Accordingly, the invention is not limited, except as by the appended claims.

The present disclosure incorporates U.S. Pat. No. 4,834,033 to Melvin J. Larsen in its entirety by reference.

The following patent applications and/or patents are incorporated herein in their entireties by reference: U.S. patent application Ser. No. 13/027,170, filed Feb. 14, 2011; U.S. patent application Ser. No. 13/027,051, filed Feb. 14, 2011; U.S. Pat. Application No. 61/237,466, filed Aug. 27, 2009; U.S. Pat. Application No. 60/626,021, filed Nov. 9, 2004; U.S. Pat. Application No. 61/312,100, filed Mar. 9, 2010; U.S. Pat. Application No. 61/407,437, filed Oct. 27, 2010; U.S. Pat. No. 7,628,137, filed Jan. 7, 2008; U.S. patent application Ser. No. 12/581,825, filed Oct. 19, 2009; U.S. patent application Ser. No. 12/653,085, filed Dec. 7, 2009; U.S. patent application Ser. No. 12/841,170, filed Jul. 21, 2010; U.S. patent application Ser. No. 12/804,510, filed Jul. 21, 2010; U.S. patent application Ser. No. 12/841,146, filed Jul. 21, 2010; U.S. patent application Ser. No. 12/841,149, filed Jul. 21, 2010; U.S. patent application Ser. No. 12/841,135, filed Jul. 21, 2010; U.S. patent application Ser. No. 12/804,509, filed Jul. 21, 2010; U.S. patent application Ser. No. 12/804,508, filed Jul. 21, 2010; U.S. patent application Ser. No. 12/913,744, filed Oct. 27, 2010; U.S. patent application Ser. No. 12/913,749, filed Oct. 27, 2010; U.S. patent application Ser. No. 12/961,461, filed Dec. 6, 2010; U.S. patent application Ser. No. 12/961,453, filed Dec. 6, 2010; and U.S. Pat. Application No. 61/523,275, filed Aug. 12, 2011.

We claim:

1. An internal combustion engine comprising:

a pair of opposing pistons;

a connecting rod operably coupling the opposing pistons to one another;

an inner cam drum having a first cam groove;

a first bearing coupled to the connecting rod, the first bearing positioned to engage the first cam groove, wherein the first bearing translates linear motion of the opposing pistons to rotation of the inner cam drum;

an outer cam drum having a second cam groove; and a second bearing coupled to the connecting rod, the second bearing positioned to engage the second cam groove, wherein the second bearing translates linear motion of the opposing pistons to rotation of the outer cam drum.

2. The internal combustion engine of claim 1, further comprising a first drive shaft and a second drive shaft, the first and second drive shafts coaxial with the inner cam drum and fixedly coupled to the inner cam drum.

3. The internal combustion engine of claim 1 wherein the outer cam drum includes a plurality of gear teeth, and wherein the engine further comprises a drive shaft operably coupled to a gear, the gear positioned to engage the gear teeth and rotate the drive shaft to drive a load.

4. The internal combustion engine of claim 1 wherein individual pistons include a piston valve, the piston valve operable from a closed position to an open position, and wherein the open position is configured to reduce a compression ratio of the engine.

5. The internal combustion engine of claim 1 wherein individual pistons include a piston valve, and wherein the engine further comprises a casing having an opening configured to provide air flow through the piston valve.

6. The internal combustion engine of claim 1 wherein individual pistons include:

a piston valve configured to provide an exhaust path;

a valve cam; and a roller bearing operably coupled to the valve cam, the roller bearing operable to rotate the valve cam to move the piston valve from a closed position to an open position.

7. An internal combustion engine comprising:

a pair of opposing pistons;

a connecting rod operably coupling the opposing pistons to one another;

an inner cam drum having a first cam groove;

a first bearing coupled to the connecting rod, the first bearing positioned to engage the first cam groove, wherein the first bearing translates linear motion of the opposing pistons to rotation of the inner cam drum;

an outer cam drum having a second cam groove; and a second bearing coupled to the connecting rod, the second bearing positioned to engage the second cam groove, wherein the second bearing translates linear motion of the opposing pistons to rotation of the outer cam drum, and wherein the rotation of the inner cam drum and the rotation of the outer cam drum are in opposite directions.

8. The internal combustion engine of claim 7, wherein the outer cam drum comprises an annular cylinder that is spaced apart from and coaxial with the inner cam drum.

9. An internal combustion engine comprising:

a plurality of cylinders disposed in a radial configuration;

a plurality of pistons, individual pistons disposed in corresponding cylinders;

a plurality of roller bearings, individual roller bearings operably coupled to corresponding pistons; and a cam positioned to engage the roller bearings; the cam including— a plurality of lobes, a cross-sectional shape configured to convert linear motion of the pistons to rotational motion, and a cross sectional diameter that varies along a central axis.

10. The internal combustion engine of claim 9 wherein the cam is translatable along the central axis from a first position to a second position, and wherein in the first position the cam provides a first lift to the pistons and in the second position the cam provides a second lift to the pistons, the first lift greater than the second lift.

11. The internal combustion engine of claim 9 wherein the cam includes a first plurality of cam lobes at a first end of the cam and a second plurality of cam lobes at a second end, the first plurality of cam lobes numbering less than the second plurality of cam lobes.

12. The internal combustion engine of claim 11 wherein the cam includes a section having a generally circular cross-sectional area.

13. An internal combustion engine comprising:

a plurality of pistons, individual pistons including a side-wall;

a plurality of roller bearings, individual roller bearings operably coupled to individual pistons;

a central cam positioned to engage the roller bearings, the central cam configured to convert linear motion of the pistons to rotational motion;

a plurality of valve cams, individual valve cams operably coupled to corresponding roller bearings, wherein the valve cams are configured to rotate with individual roller bearings;

a plurality of piston valves, individual piston valves operably coupled to corresponding pistons; and a plurality of rollers, individual rollers operably coupled to corresponding piston valves by valve stems, the plurality of rollers configured to engage corresponding valve cams and operate the individual piston valves between a closed position and an open position.

14. The internal combustion engine of claim 13 wherein the central cam includes a first plurality of cam lobes at a first end of the central cam, and a second plurality of cam lobes at a second end of the central cam, the first plurality of cam lobes numbering less than the second plurality of cam lobes, the central cam configured to translate along a rotational axis to provide varying lift and varying torque multiplication for the internal combustion engine.

15. The internal combustion engine of claim 14 wherein the first plurality of cam lobes comprises three cam lobes and the second plurality of cam lobes comprises five cam lobes.

16. The internal combustion engine of claim 13 wherein the central cam includes a section having a generally circular cross-sectional area, the section configured to provide a transition from a first torque multiplication to a second torque multiplication.

17. The internal combustion engine of claim 13, further comprising a ventilated casing, the ventilated case providing an exhaust path for combustion products.

* * * * *